US008627772B2

(12) United States Patent
Wicks et al.

(10) Patent No.: US 8,627,772 B2
(45) Date of Patent: Jan. 14, 2014

(54) INTERMODAL RAIL VEHICLE TO FORM A TRAIN

(75) Inventors: Harry O. Wicks, El Paso, TX (US); Michael W. DiLuigi, Alpharetta, GA (US); Joseph Magri, Braintree, MA (US)

(73) Assignee: RailRunner, N.A., Inc., Lexington, MA (US)

( * ) Notice: Subject to any disclaimer, the term of this patent is extended or adjusted under 35 U.S.C. 154(b) by 0 days.

(21) Appl. No.: 13/514,358

(22) PCT Filed: Dec. 7, 2010

(86) PCT No.: PCT/US2010/059240

§ 371 (c)(1),
(2), (4) Date: Sep. 14, 2012

(87) PCT Pub. No.: WO2011/071887

PCT Pub. Date: Jun. 16, 2011

(65) Prior Publication Data

US 2012/0325107 A1 Dec. 27, 2012

Related U.S. Application Data

(60) Provisional application No. 61/267,226, filed on Dec. 7, 2009.

(51) Int. Cl.
*B61D 17/00* (2006.01)

(52) U.S. Cl.
USPC ..... 105/4.2; 105/4.1

(58) Field of Classification Search
USPC ..... 105/4.1, 4.2, 4.3, 4.4, 159, 199.1, 105/199.2, 215.2; 410/53, 56, 57
See application file for complete search history.

(56) References Cited

U.S. PATENT DOCUMENTS

| | | | | | |
|---|---|---|---|---|---|
| 2,784,857 | A | * | 3/1957 | Duffy | 414/481 |
| 2,873,982 | A | * | 2/1959 | Graham | 280/478.1 |
| 3,073,622 | A | * | 1/1963 | Merritt | 172/605 |
| 5,107,772 | A | * | 4/1992 | Viens | 105/159 |
| 5,192,057 | A | * | 3/1993 | Wydra et al. | 267/153 |
| 5,291,835 | A | * | 3/1994 | Wicks | 105/4.2 |
| 5,431,110 | A | * | 7/1995 | Adams, Jr. | 105/4.1 |
| 5,890,435 | A | * | 4/1999 | Thoman et al. | 105/404 |

(Continued)

FOREIGN PATENT DOCUMENTS

| | | | |
|---|---|---|---|
| CN | 101888944 | A | 11/2010 |
| WO | WO 2009/085632 | A1 | 7/2009 |

*Primary Examiner* — Jason C Smith

(74) *Attorney, Agent, or Firm* — Leydig, Voit & Mayer, Ltd.

(57) ABSTRACT

The improved intermodal vehicle has a one-piece upper frame assembly with a horizontal load carrying surface below the ends of a drawbar for connecting the trailers. Each highway trailer has a coupler socket assembly at both its front and rear into which the drawbar enters and connects to the intermodal vehicle by a vertical coupling pin projecting upward from the horizontal load carrying surface. The coupling pin is operated up and down by either manual or air operated actuators, and locks in the up position by a manually operated safety latch. The upper frame is supported from dual steerable lower frames by primary air springs so that when the springs are deflated, the upper frame is lowered to allow the trailers to be pushed upon the load carrying surface. When the air springs are inflated, the trailers are raised so that the trailer wheels are carried above the railroad track.

16 Claims, 18 Drawing Sheets

(56) References Cited

U.S. PATENT DOCUMENTS

| | | | | |
|---|---|---|---|---|
| 6,050,197 | A * | 4/2000 | Wicks | 105/4.2 |
| 6,276,282 | B1 * | 8/2001 | Schunke | 105/4.1 |
| 6,393,996 | B1 * | 5/2002 | Duncan et al. | 105/4.2 |
| 2007/0089637 | A1 * | 4/2007 | Sproat | 105/72.2 |
| 2008/0095484 | A1 * | 4/2008 | Wirges et al. | 384/536 |
| 2012/0325107 | A1 * | 12/2012 | Wicks et al. | 105/215.2 |

* cited by examiner

INTERMODAL RAIL VEHICLE TO FORM A TRAIN

CROSS-REFERENCE TO RELATED APPLICATIONS

Portions of the present disclosure are supplementary to the disclosure provided in U.S. Provisional Application for Patent, Ser. No. 61/015,545, which was filed on Dec. 20, 2007, and which was subsequently filed under the Patent Cooperation Treaty as International Patent Application No. PCT/US2008/086,370 on Dec. 11, 2008, which is incorporated herein in its entirety by reference, and also supplementary to the disclosure of U.S. Provisional Application for Patent, Ser. No. 61/267,226, filed Dec. 7, 2009.

BACKGROUND OF THE INVENTION

The prior art discloses intermodal vehicles for use in forming a train of highway trailers including leading and trailing trailers interconnected to each other and supported by the intermodal vehicles. The intermodal rail vehicle of the present disclosure may be used with trailers of any configuration, including trailers designed for hauling "ISO" shipping containers. Each of the highway trailers includes a coupler socket assembly at its leading end and a coupler socket assembly at its trailing end. Each socket assembly is provided with a pair of vertically spaced apart aligned apertures for receiving a vertical coupling pin.

The intermodal vehicles are characterized by two lower frame assemblies, each supported by a rail wheel and axle assembly and a one-piece upper rifting frame assembly supported by the two lower frame assemblies by spring means. The spring means includes air springs which are arranged so that when air is evacuated from the air springs, the upper lifting frame will descend toward the lower frame assemblies and when air is added to the air springs, the upper lifting frame will rise and concurrently raise any trailers resting thereon to a height sufficient so that the trailer wheels are clear of the railroad track. In addition to this primary spring means, a secondary spring means is provided so as to support the trailer above the track in the event of failure of the primary air springs. In addition to a horizontal trailer support surface, the upper lifting frame includes a coupler tongue, or drawbar, which is formed to be received in the coupler socket of the trailer.

Each end of the coupler tongue is provided with an aperture for receiving a vertical coupling pin which rises from the upper lifting frame to pass through the coupler socket assembly in the trailer and at the same time pass through the coupler tongue within the socket, thus effecting a connection between the intermodal vehicle and the trailer resting thereon. It is also a feature of the prior art that the lower frames are steerable with respect to the upper frame assembly. The prior art also discloses a transition vehicle or other means for connecting a unit train of intermodal vehicles having a unique coupling system to the "knuckle" couplers found on conventional trains.

A standard wheel set on a railcar consists of a pair of rigid side frames suspended on a spring system with a pair of axles having wheel sets mounted in bearing sets between the side frames. This configuration allows virtually no motion other than the minimal clearance of the wheels and axles relative to the frames or to one another during operation. In this arrangement, although the bogie can pivot on a central bearing, the wheels are unable to follow the contour of the rail curvature or yaw (in general, yaw is defined as the rotation of an object about a vertical rotational axis). The fixed orientation of the bogie axles in the side frames results in lateral forces and wear on the wheels, the wheel flanges, and degradation of ride quality with increasing speed. Degraded ride quality at higher speeds is attributed to a phenomenon known as "hunting," which describes the periodic sinusoidal yawing motion of the bogie about its center bearing during operation.

This hunting motion is caused by a rail-to-wheel interaction that is especially prevalent as the wheels progress around a corner and can be occasioned by track irregularities that cause the wheel sets to yaw. In certain circumstances, the aforementioned interaction is so severe that it causes the flange of the wheel to climb the rail, causing an aggressive lateral correction or, in extreme cases, a derailment.

Improved ride quality and reduced rail and wheel wear has led to a number of improvements to the wheel set suspensions of rail vehicles. The goal of such improvements has been to create arrangements that constrain or allow the steering of the wheels and axles of the bogie to follow the curvature of the track. A recent development, which was driven by the requirements of high speed passenger rail requirements, has been the articulated bogie, which includes an articulation joint between the two lower frames that allows steering of the bogie.

In general, rail bogies can be divided into three groups based on the energy source of the mechanism that controls steering at the articulation joint between two articulated wheel portions of the bogie. A first group includes wheel sets yawed by contact forces between the rail and the wheels of the bogie. In a second group, wheel sets are yawed by the relative rotation between the bogie frame and vehicle body. Bogies in this second group can exhibit either yaw or roll, and typically utilize a system of links or levers to steer the trailing wheel set by the leading wheel set. One example of this type of bogie is commonly referred to as the Sheffel bogie, which uses a series of levers connected to one axle set to cause the rotation of the second axle set. In a third group of bogies, the wheel sets of the bogie are actively yawed by an external energy source, for example, by use of electric, hydraulic, or pneumatic actuators.

The prior art has validated the idea of making a train of highway trailers with steerable intermodal vehicles which permit the make-up of a train without the need for cranes or other lifting devices; however, these prior intermodal vehicles are unnecessarily complex and it is beneficial to the art to provide a simplified intermodal vehicle of an improved design which corrects some of the weaknesses and complications found in the prior art.

OBJECTS AND SUMMARY OF THE INVENTION

In one embodiment, a bogie in accordance with the disclosure includes two axles and wheel sets similar to those of a standard bogie, but instead of using a rigid side frame such as those in use on standard bogies, each axle and wheel set is housed in its own lower frame. This feature allows the wheels, together with the two connected frames, to follow the curvature of the track and is the basis for the articulation of the disclosed embodiments. The upper frame is suspended separately from the lower frames by an air suspension system of eight air bags, four per frame. These air bags, in conjunction with four elastomeric shear pads mounted on each lower frame, create straight running restoring forces and damping. A total of eight elastomeric shear pads are present on the two lower frames and are linked to the upper frame of the bogie by four rods that are rigidly mounted to the upper frame and which pass through a plate mounted to the upper surface of the shear pads.

The bogie further includes an articulated joint between the two lower wheel frames. The articulated joint includes a clevis with a pin mounted vertically though a hardened bushing with a spherical tapered bore. This arrangement allows rotational capability of the lower frames relative to one another along a vertical axis at the center of the wheel axles and allows for pitching capability between the two lower frames.

In this first embodiment, the bogie's upper frame is rigid and has no yawing or pitching capability other than motions on its air bag suspension system. As is known, violent yawing can be caused by a single axle bogie having insufficient damping and restoring forces, which must be provided to restrict the uncontrolled yawing or "hunting" of each single axle set. In this first embodiment, restoring and damping forces are provided by the suspension system mentioned above.

The yawing capability provides steering between the axle sets of the bogie without linkages or active actuation. Steering of this type is often called "self steering." The disclosed embodiment provides excellent ride characteristics and low, transmission of forces from irregularities in the rail to the upper frame and, consequently, to the load being conveyed.

Moreover, the articulation of the lower frame through the center pin and bushing reduces lateral forces on the wheels and the track during curving and in-line operation. Known information on the subject indicates that lateral force reductions can be achieved on the order of 30-50% depending on vehicle speed and axle load. The lower forces reduce track and wheel flange wear and improve overall ride characteristics. The bogie in accordance with the first embodiment is rigid in the longitudinal, vertical and lateral directions. This has had an adverse impact on components of the lower frame and the clevis connection in the form of wear of the centerlink pin and bushing, as well as the suspension pin coupling the Upper Frame to the elastomeric mounts on the lower frame.

As is known, forces causing wheel and track wear can be attributed to several factors. Were it not for the centerlink pin and bushing arrangement of the first embodiment, the bores for the centerlink pin would only be concentric with one another in one position, that is, a stationary, unloaded, bogie on straight track. If one were to elevate the vehicle from the track and rotate the axle sets about a vertical centerline located laterally in the middle of each axle, one would notice that the vertical centerlines would draw closer together by a small amount. A force opposing this motion would be provided by the elastomeric pads and pins from the upper frame.

During cornering or cresting a hill, the rotation center of the lower frame can be found at the centerline of the axles as noted above. All motion that is any distance from the axle bearing axis or the vertical axis through the center of the axle causes the clevis bores to move away from concentricity. These small motions are restrained in the bogie of the first embodiment by the center link pin, but have significant forces associated with them due to the deflection of the shear pads, as well as the inertia of the lower frames. Such small forces can generate significant impact loads if dissipated over small distances.

When intermodal vehicles are being loaded, a chassis is pushed up the ramp of an intermediate unit (IU), which is a bogie positioned between two intermodal chassis, or a transition unit (TU), which is a bogie accommodating a chassis on one end and having a standard rail coupler on its other end. During the loading process, a large unbalanced load is suddenly forced onto the lower frame. Even though the top frame is rigid and placed on both lower frames, the unbalance causes a pitching moment around the axle bearing set on the side of the loaded trailer. For the IU this force is balanced when the second trailer is placed on the opposite side. The forces on the TU are somewhat balanced when the chassis is moved to the locking pin engagement position. This position is forward of the center-link and balances the forces on the lower frame.

In the first embodiment, a height difference, such as the height difference present when cresting a small hill or traversing a vertical discontinuity in the rail, can be accommodated by a combination of vertical movement of the leading lower frame axle and a pitching downward at the rear of the leading frame member about the axle caused by the connection to the lower frame through the centerlink. The trailing axle set will respond with an upward pitching about the axle. The centerlink design in accordance with the first embodiment has a limited degree of freedom in this motion with a potential jamming of the pin in its bushing. This jamming can result in a loss of a rotational degree of freedom at the centerlink due to the increase of friction and jamming of the pin and bushing.

Taken in combination these forces have been sufficient to cause yielding of centerlink pin housing, wear of the connection pins from the upper frame to the lower frames and fracturing of pins in previous designs of the centerlink bushing. Once damaged, repair of the center-pin is quite difficult because the clevis members are welded in position. The IU or TU must be removed from service and the failed components cut off. Replacement of these members must be accomplished by welding, which is a process requiring nearly a full day.

The disclosure further provides a second, improved embodiment of a bogie having a gimbaled connection between the two lower frames. The improved design centerlink or gimbaled design reduces the impact forces imposed on the link components by allowing compliance in three rotational dimensions and one linear dimension. The improved center link includes two link halves held in contact by a spring member concentrically located on a bolt or other connection device between the two link halves. Alternately, one or more elastomeric or spring element (s) that provide freedom of motion in the desired directions of pitch, yaw, roll, and translation with sufficient restoring force can be used. Connection of the coupling to the lower frames is accomplished by a joint similar to a universal or gimbal joint. This allows the lower frames to move in an independent manner in rotation in pitching, rolling, yawing, and longitudinal extension. Restoring forces are provided by the spring member holding the two link halves together as well as the existing elastomeric pads. Some restoring force must still be present otherwise the hunting of the wheel sets might tend to increase. A significant axial force is also needed to resist the separation of the two lower frames under braking.

The design of the centerlink of the second disclosed embodiment will allow for self steering in curves as small as 150 ft. (about 46 meters), while also improving the bogie's ability to negotiate track or rail bed irregularities. The gimbal is attached to each lower frame, thus allowing each frame to move vertically and laterally, as well as rotate relative to one another. Rotation is enabled by a single fastener disposed longitudinally between the two lower frames. This increase in flexibility at the centerlink eliminates wear of the components and directs the motion of the lower frames into bushings and shafts that are designed to accommodate such motion as well as withstand the resulting forces.

The additional compliance at the centerlink is expected to reduce wear on the pins at the elastomeric shear pads. In the first embodiment, the pins are required to withstand the forces generated by the movement between the rigid upper frame and the longitudinally rigid and minimally flexible pitching action created by the center pin, bushing, and clevis arrangement. By allowing more deflection at the centerlink in accordance with the second embodiment, lower deflection and, thus, lower forces occur at the shear mounts. The total deflection is controlled by the spring elements. In order to guarantee that sufficient resistance to the application of the brakes is always available, the springs or spring members are sized to resist the full brake force. Should more force be applied, the springs will reach their solid height providing a positive limit to travel.

The braking system in the disclosed embodiments utilizes four contact points or brake shoes, one for each wheel. This is unlike earlier railroad brake models that used eight shoes with two shoes opposing one another on opposite sides of each wheel. The brake shoes in the disclosed embodiments are located between the axles and press outward in a longitudinal direction in opposite directions. This braking action generates significant torque loading at the interface between the wheels and the rails that cause the lower frames to pitch about the rail and the wheel contact point. Although the bushing bore of the present design is spherical, this feature will not allow separation of the concentricity of the clevis bores. The spherical nature of bushing in the clevis does not allow enough angulation of the center-pin before jamming in the bore of the bushing. This jamming will create large prying forces against the bushing and its housing. Braking also produces large forces trying to separate the two lower frames which cannot occur because of the longitudinal rigidity of the present system.

The gimbaled centerlink design of the second embodiment replaces the welded attachment of the clevis components with a bolted design, which also significantly reduces repair time. The disclosure further provides a third improved embodiment of a bogie having an elastomeric connection between the two lower frames. The elastomeric design centerlink further reduces the impact forces imposed on the link components by allowing compliance in three rotational dimensions and one linear dimension. The elastomeric centerlink design of the third embodiment retains the bolted connection to the two lower frames described in the second embodiment.

Based on the foregoing, it is one object of the present invention to provide an improved intermodal vehicle wherein the upper load supporting frame is a one-piece welded assembly which is supported by two lower steerable lower frame weldments; there being coupler tongues in the form of a two level coupler tongue/drawbar assembly in a fixed relationship to the load supporting surfaces on the upper frame assembly, said drawbar assembly having front and rear vertically extending apertures which receives a vertically movable coupler pin extending from the upper frame assembly for securing the intermodal vehicle to front and rear highway trailers.

In the prior art, U.S. Pat. Nos. 5,291,835 and 5,890,435 show four air springs, one over each rail wheel. U.S. Pat. Nos. 6,050,197 and 6,393,996 show eight air springs, one at each corner of the two lower frame assemblies. In all these patents, a provision is made for a backup suspension system which will support the upper frame in the event of a failure of the primary air springs. In patents '835 and '435, the backup support is provided by a solid rubber cushion internal to each air spring; Patent '996 provides a backup system consisting of eight steel coil springs positioned between the two lower frames and the upper frame assembly. The coil springs of the '996 patent require that pressure plates ("paddles") be in position above the coil springs when the intermodal vehicle is raised to the rail travel position and that the pressure plates be moved away to allow the upper frame to be lowered. This positioning of the pressure plates is accomplished by a system of levers and operating rods interconnected to the cover of the control valve box. It is an object of the present invention that urethane bumpers mounted to the side beams of the lower frame assemblies are used in lieu of the coil springs, and movable pressure beams are to be mounted to the upper lifting frame and positioned above these bumpers. In the preferred embodiment, shifting of the pressure beams to a position above the bumpers is accomplished by air cylinders and to a position away from the bumpers by a manual operating lever. Alternatively, the pressure beams may be operated wholly by mechanical means or wholly by air cylinders.

In the prior art of patent '996, the drawbar for coupling the trailers to the intermodal vehicle is at the same height above the track at each end. On a trailer, the coupler socket at the front end is at a different height from the rear end; as a consequence, a train of trailers will not run level on the tracks if both ends of the drawbar are at the same height from the track. An object of the present invention is to provide a drawbar with one end higher than the other; thus the trailers will run level on the tracks.

In the prior art of patent '996, activation of the coupling pin is accomplished by a double acting air cylinder acting through a system of levers. A disadvantage of this is that the cylinder rod is exposed to grit and grime which will shorten the life of the cylinder and presents a potential safety issue. An object of the present invention is for the operation of the coupling pin to be through the use of all-rubber air actuators, for example, as manufactured by Firestone Rubber Company. These actuators are similar to the air springs used in the primary suspension of the intermodal vehicle, albeit smaller, and have no metal parts which could be damaged by exposure to deleterious conditions.

In the prior art of patent '996, the steerable lower frames are returned to their neutral center position by vertical guide rods which pass through the upper and lower plates of rubber-in-shear "sandwich" springs. These springs are directly in the path of dirt, grime and oil thrown up from the track bed during normal rail travel; this exposure is highly destructive to the rubber springs. An object of the present invention is that these rubber springs be replaced by a return assembly using urethane elements which are unaffected by the aforementioned deleterious matter and at the same time the guide rods function also to limit the lifting height provided by the air springs as well as to prevent the upper frame from separating from the lower frames.

The prior art of patent '996 shows a ball joint at the connection between the lower frames to accommodate rocking and other motions between the frames. This ball joint arrangement is prone to wear and possible premature failure of the connection because of longitudinal shock in the ball joint as the train travels along the track. Additionally, this arrangement does not allow for increases in the distance due to changes in angular relationship between the lower frames resulting from the motion of these frames in operation. Therefore, a further object of the present invention is to allow movement of the lower frames so that loads are reduced in this connection and at the guide rods. During operations such as cornering or braking, the frames are prevented from moving by a center element consisting of a pin and an hourglass shaped aperture. In one embodiment of the present disclosure, a center link assembly accommodates such motions between the lower frames. The link includes two yokes that are held in contact by several spring elements. These elements are connected to the two frames by means of pins and yokes so that lateral, vertical, and rotational motions are permitted.

In one aspect, a further object of the present invention is to allow the connecting elements from the opposite lower frames to be in contact, thus eliminating longitudinal movement. In lieu of the ball connection, an "hourglass" shaped aperture in the center element is provided to allow for rocking and rolling motions. Rotational movements of the frames relative to one another are provided for by rounding the ends of the connecting elements. In addition, in order to further cushion possible longitudinal movement, bumpers are provided between the frames. In one further embodiment, the lower frames are interconnected by a novel connector arrangement providing four degrees of freedom for motion between the lower frames. More specifically, the novel connector arrangement advantageously provides for pitch, yaw, and roll motion between the lower frames, as well as providing a controlled degree of extension between the lower frames that can advantageously reduce stress in the connector arrangement during acceleration, braking, and rail car bumping forces occurring between the two lower frames during service.

In the prior art of patent '996, to facilitate the positioning of the rear of the trailer upon the intermodal vehicle, a sloping ramp is provided, which serves as a guiding and centering means for the trailer by contacting the trailer's frame. No provision is made for centering the front of the trailer. In the procedure for making up a train, an intermodal vehicle is positioned on the track and a trailer, propelled by a yard tractor, is backed upon the intermodal vehicle. The yard tractor continues to push the trailer and intermodal vehicle back into engagement with the front end of a second trailer. The tractor then unhooks from the trailer and pulls away. An object of the present invention is to provide "lugs" on the feet of the second trailer's landing gear which will contact the inner surfaces of the track heads, thus centering the end of the trailer with respect to the intermodal vehicle.

In the prior art as well as the present invention, the connection of the intermodal vehicle to the trailer is accomplished by entry of the ends of a drawbar attached to the intermodal vehicle into sockets in the trailers and fixed therein by a coupling pin rising from the vehicle through the upper and lower plates of the coupler socket and at the same time through an aperture in the drawbar.

As an alternative however, an automatic coupling means may be useful in some situations; for example in a short, "sprint" train where speed of train make up may be a factor. Accordingly an automatic coupler means is shown as an alternate to the coupling means shown on the patents of the prior art and is described herein.

A transition vehicle for coupling the train of trailers with standard "knuckle" couplers for connecting the trailers of this invention to standard railcars or a locomotive is shown in U.S. Pat. No. 6,393,996, which is incorporated herein in its entirety by reference, and will not be further described.

The foregoing design features of the present invention will be better understood after a consideration of the following detailed description in conjunction with the accompanying drawings in which the best way of practicing this invention is illustrated.

BRIEF DESCRIPTION OF THE DRAWINGS

FIG. 1 showing the trailers and an intermodal vehicle before makeup, with the rail vehicle being shown in the down position, and FIG. 2 showing the intermodal vehicle connected to the trailers with the intermodal vehicle in its raised position.

DETAILED DESCRIPTION OF THE DRAWINGS

Figure 1:
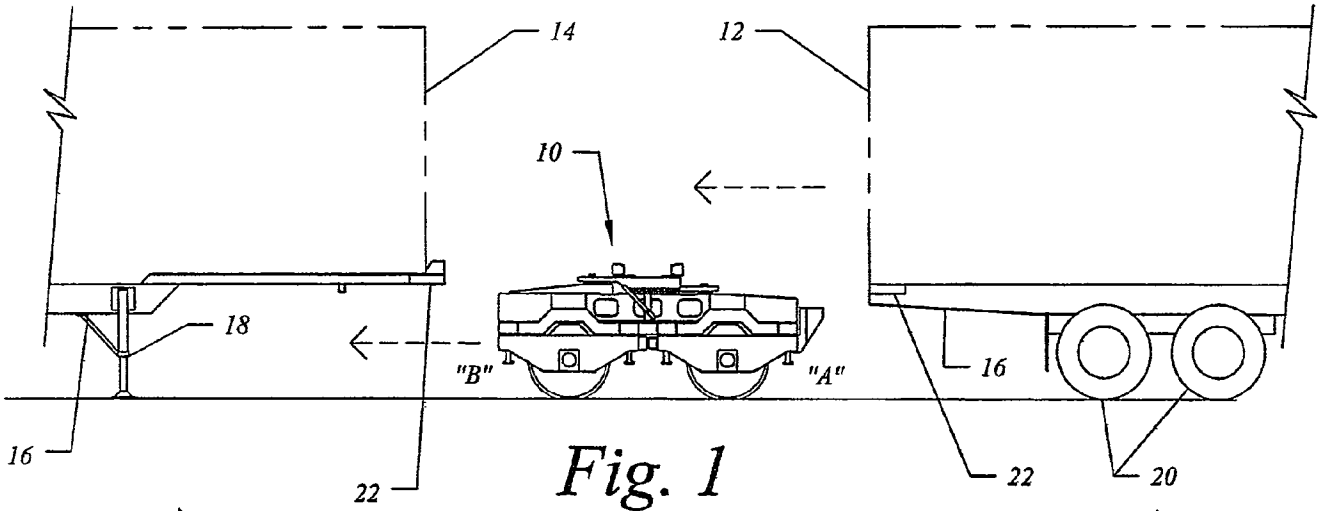
FIGS. 1 and 2 illustrate how a train can be made up using leading and trailing highway trailers and an intermodal rail vehicle.
Figure 2:
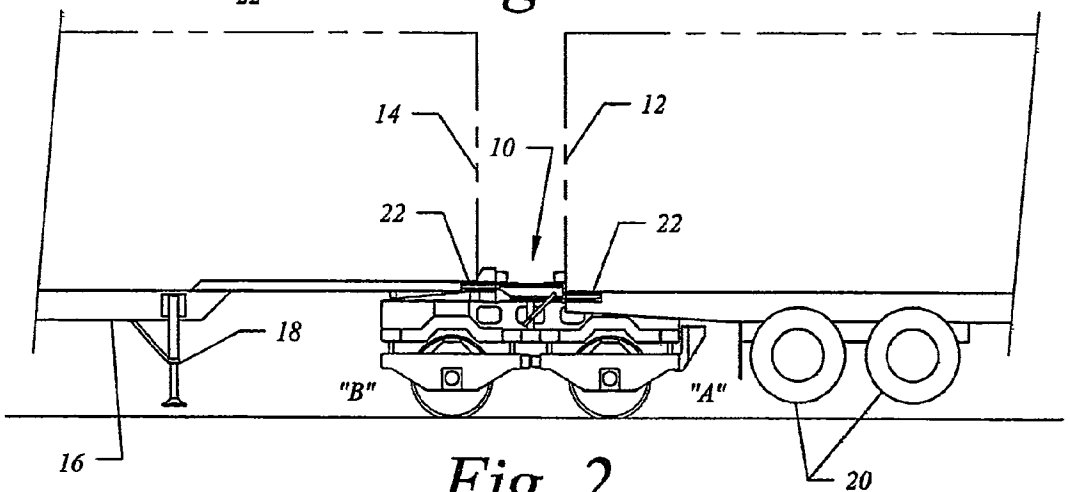

In the following description right and left hand references are determined by standing to the rear of one of the trailers and facing the direction of travel. With reference initially to FIGS. 1 and 2, the intermodal vehicle of this invention may be used in conjunction with other intermodal designs and highway trailers of any style to form a train of highway trailers. The front end of the train thus formed is supported by a transition vehicle as shown in U.S. Pat. No. 6,393,996, incorporated by reference herein, which has a standard "knuckle" coupler on one end for coupling to a standard railcar or locomotive and a coupler tongue at the other end for coupling to the trailer socket of this invention. The rear end of the train of trailers is similarly supported by another of said transition vehicles.

With reference now to FIGS. 1 and 2, the intermodal vehicles are indicated generally at 10, a highway trailer indicated generally at 12, and another highway trailer is indicated generally at 14. The highway trailers 12 and 14 are similar to the trailers shown and described in U.S. Pat. No. 6,393,996. Initially it should be observed that all of the highway trailers for use with this invention are of the same configuration. Thus, the trailer 12 is identical to the trailer 14.

Each of the highway trailers is provided with a main frame 16 consisting of a pair of longitudinally extending spaced apart centrally located rails which may be used to guide the rear end of the leading trailer onto the intermodal vehicle of this invention by contacting a centering guide on the intermodal vehicle. In addition, each of the trailers is provided with a forward landing gear 18 and highway wheel assemblies including wheels 20.

As previously stated, each highway trailer is provided with front and rear identical coupler sockets 22. The rear trailer socket is higher from the ground than the front trailer socket. Details of the coupler socket is shown and described in U.S. Pat. No. 6,393,996. In any event, each coupler socket may receive one end of a coupler tongue, or drawbar, and it should be noted that the drawbar, fastened to the top of the intermodal vehicle is higher for the front of a trailer and lower for the rear of a trailer, such that the trailers will be substantially flat when running on the track. Each socket assembly is further provided with vertically spaced apart aligned apertures to facilitate securing one end of the drawbar assembly within the socket assembly by means of a vertical coupler pin carried by the upper frame of the intermodal vehicle.

The Intermodal Vehicle

In the description that follows, elements or structures appearing in multiple drawings that are the same or similar as those described relative to a preceding drawing are denoted by the same reference numeral as previously used for simplicity. With reference to FIGS. 3 through 8A, the intermodal vehicle of this invention consists of an upper frame weldment indicated generally in plan view at 26 in FIGS. 4 and 4A and in elevation in FIGS. 5 and 5A; a leading lower frame weldment generally in plan view at 28 in FIG. 3 and in elevation in FIGS. 5 and 5A and a trailing lower frame weldment generally in plan view at 30 in FIG. 3 and in elevation in FIGS. 5 and 5A. An alternative embodiment for the leading and trailing lower frames 128 and 130 having a coupling arrangement 100 therebetween is illustrated from various perspectives in FIGS. 3C through 3F. It is noted that the leading and trailing lower frames 128 and 130 may advantageously be structurally the same or, alternatively, mirror images of each other.

The main components of the lower frame weldments 28, 128, 30, and 130 are two side frame weldments 31, two transverse cross channels 32, two longitudinal spring support beams 33, two transverse spring support bars 34, and one spring support plate 35. These two lower frame weldments are essentially identical except for the connector assembly which is used to connect the lower frame weldments to one another, and to connect a trailer centering and guide weldment 36 on the lower frame weldment to center the trailer on the intermodal vehicle during the train makeup procedure.

Figure 3:
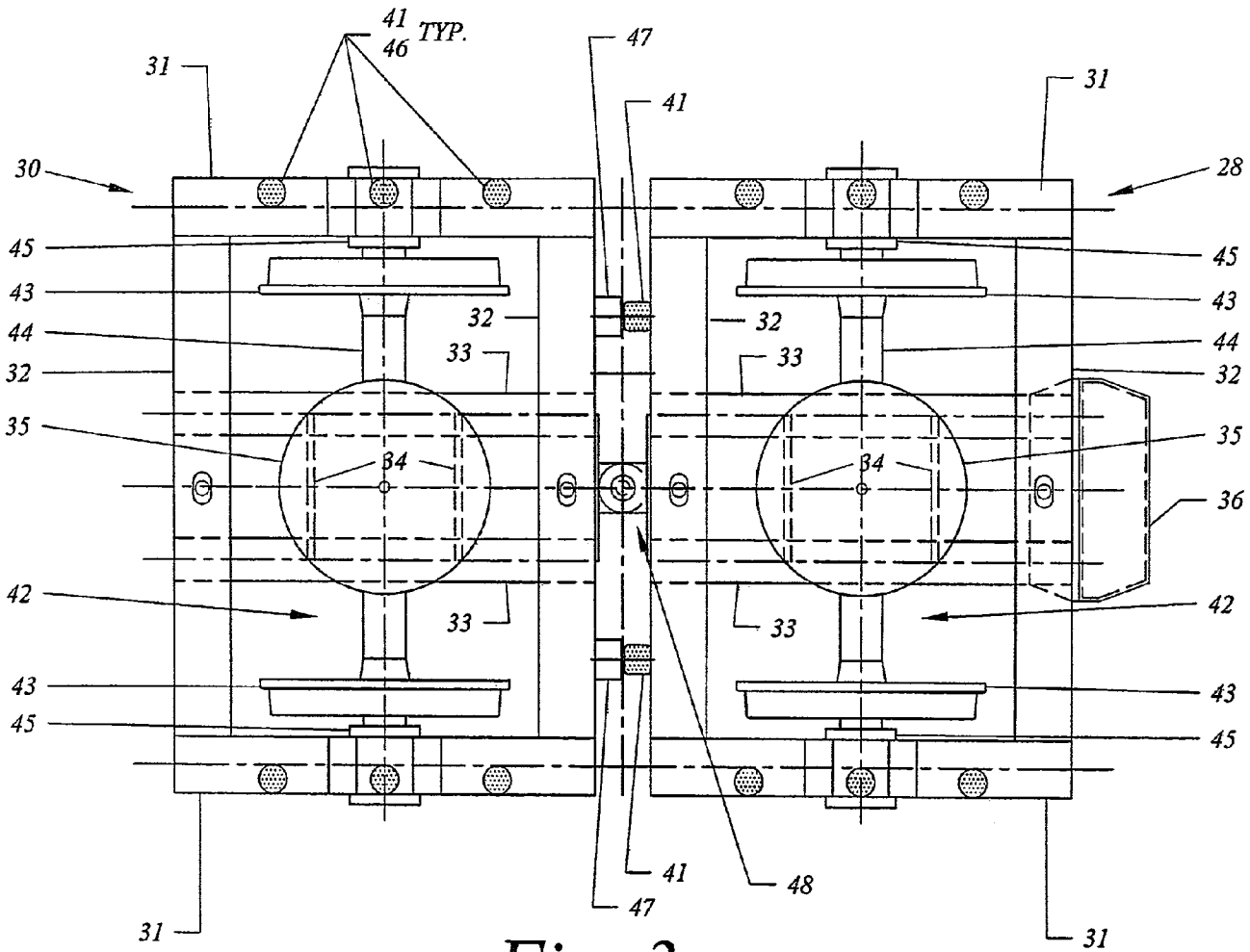
FIG. 3 is a plan view of a first embodiment of the lower frames.
Figure 3A:
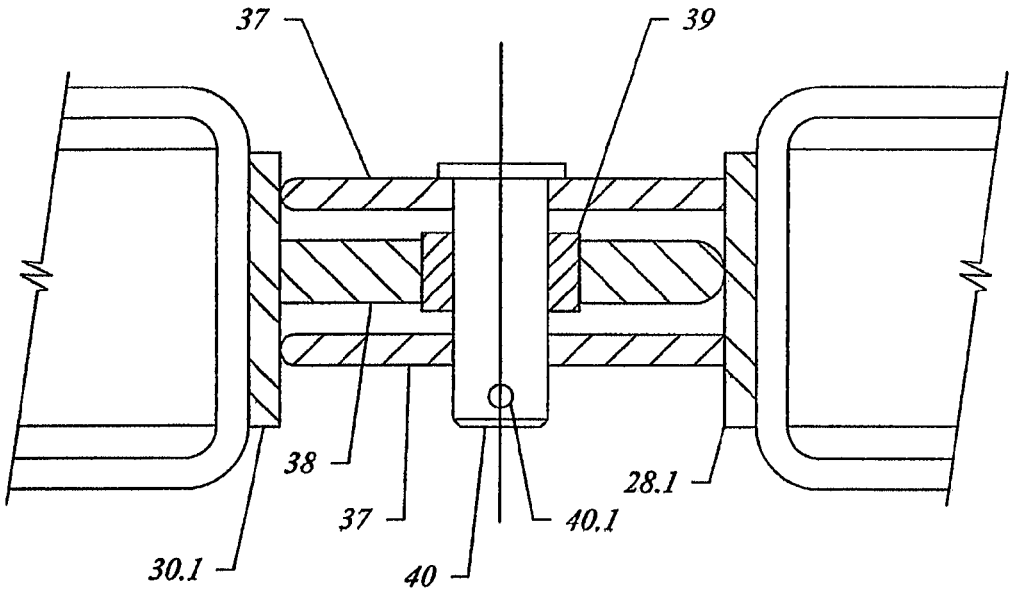
FIG. 3A is an enlarged side view of the connection between the two lower frames shown in FIG. 3.
Figure 3B:
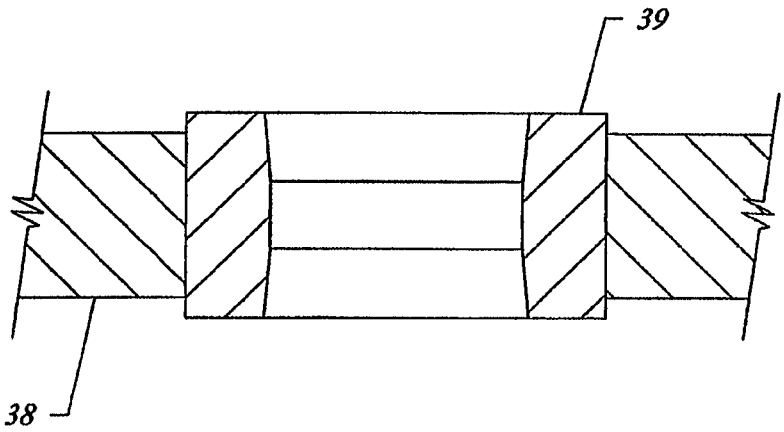
FIG. 3B is a cross-section of the bushing in the central connection bar of the first embodiment for the lower frames shown in FIG. 3.
Figure 3C:
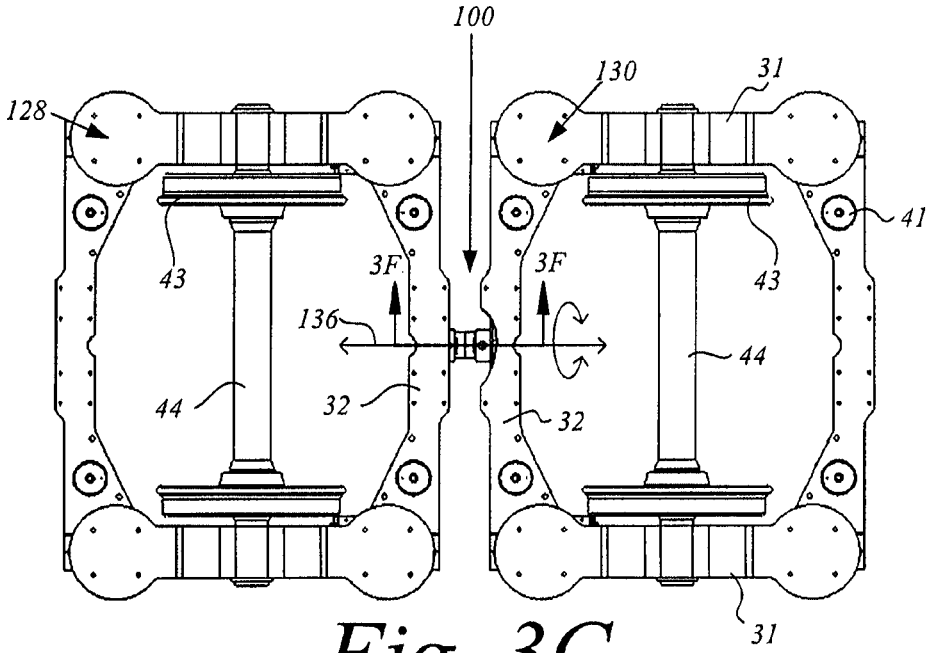
FIG. 3C is a plan view of an alternate, second embodiment of the lower frames.
Figure 3D:
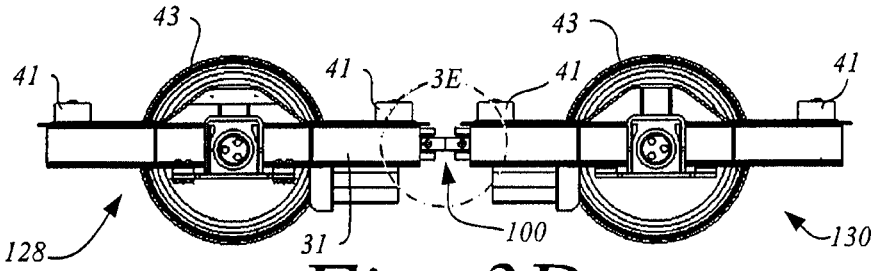
FIG. 3D is a side view of the second embodiment for the lower frames shown in FIG. 3C.
Figure 3E:
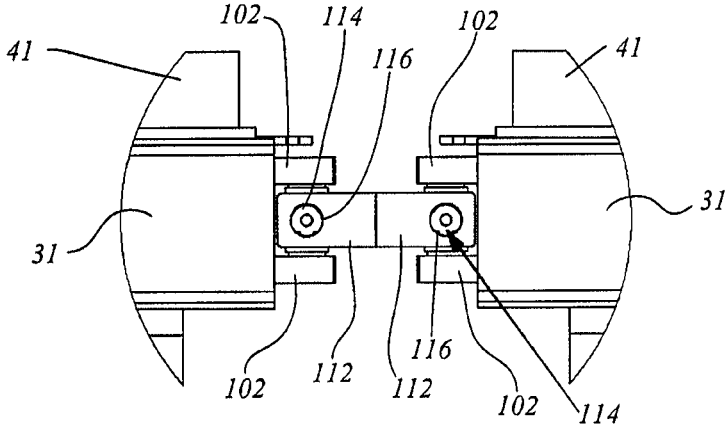
FIG. 3E is an enlarged side view of the connection between the two lower frames shown in FIG. 3C and FIG. 3D, which includes a gimbaled arrangement in accordance with the disclosure.

In one or a first embodiment, as shown in FIGS. 3-3B, the lower frame weldment 28 is provided with a single connector plate 38 which receives a bushing 39. The central portion of bushing 34 is so designed that at its center section it will receive a connection pin 40 as shown in FIG. 3A. The bushing is tapered in three parts, top to bottom, approximately 5 degrees so the connection pin may rock fore, aft and side to side as the two lower frame weldments themselves rock during transit.

In a further or second embodiment, as shown in FIGS. 3C-3F, the lower frame weldments 128 and 130 are interconnected by a gimbaled connection arrangement 100. In this embodiment, each lower frame weldment 128 and 130 is provided with a pair of bearing blocks 102 and a pair of bearings 104, which form part of the gimbaled connection arrangement 100. Each pair of bearings 104 is disposed to provide freedom for rotational motion between the bearing blocks 102 and a central connection pin 106. The central connection pin 106 is an elongate pin forming a shoulder portion 108 over a mid-portion thereof that axially restrains the central connection pin 106 between the bearing blocks 102. Each bearing block 102 forms a connection pin opening 110, which concentrically supports a respective bearing 104 and an end of the central connection pin 106.

The gimbaled connection arrangement 100 further includes a yoke or center link pin retainer 112 rotatably disposed around the shoulder portion 108 of each central connection pin 106. Each center link pin retainer 112 is retained to each central connection pin 106 via a bearing pin 114 passing through an opening 115 formed at the mid portion of each central connection pin 106 and extending diametrically therethrough. In the illustrated embodiment, each bearing pin 114 is axially secured within each center link pin retainer 112 by use of snap rings 116 disposed at both ends of each bearing pin 114. As shown, the bearing pin 114 extends parallel to the axis of rotation of the wheel axles.

A first axis of rotational freedom of motion provided between the center link pin retainer 112 and the lower frame weldments 128 and 130 coincides with a longitudinal axis 118 of the central connection pin 106 on either side of the gimbaled connection arrangement 100. Similarly, a second axis of rotational freedom of motion provided between the center link pin retainer 112 and the lower frame weldments 128 and 130 coincides with a longitudinal axis 120 of the bearing pin 114 on either side of the gimbaled connection arrangement. The first and second axes of rotational freedom coinciding, respectively, with the longitudinal axes 118 and 120 are orthogonal relative to one another.

Figure 3F:
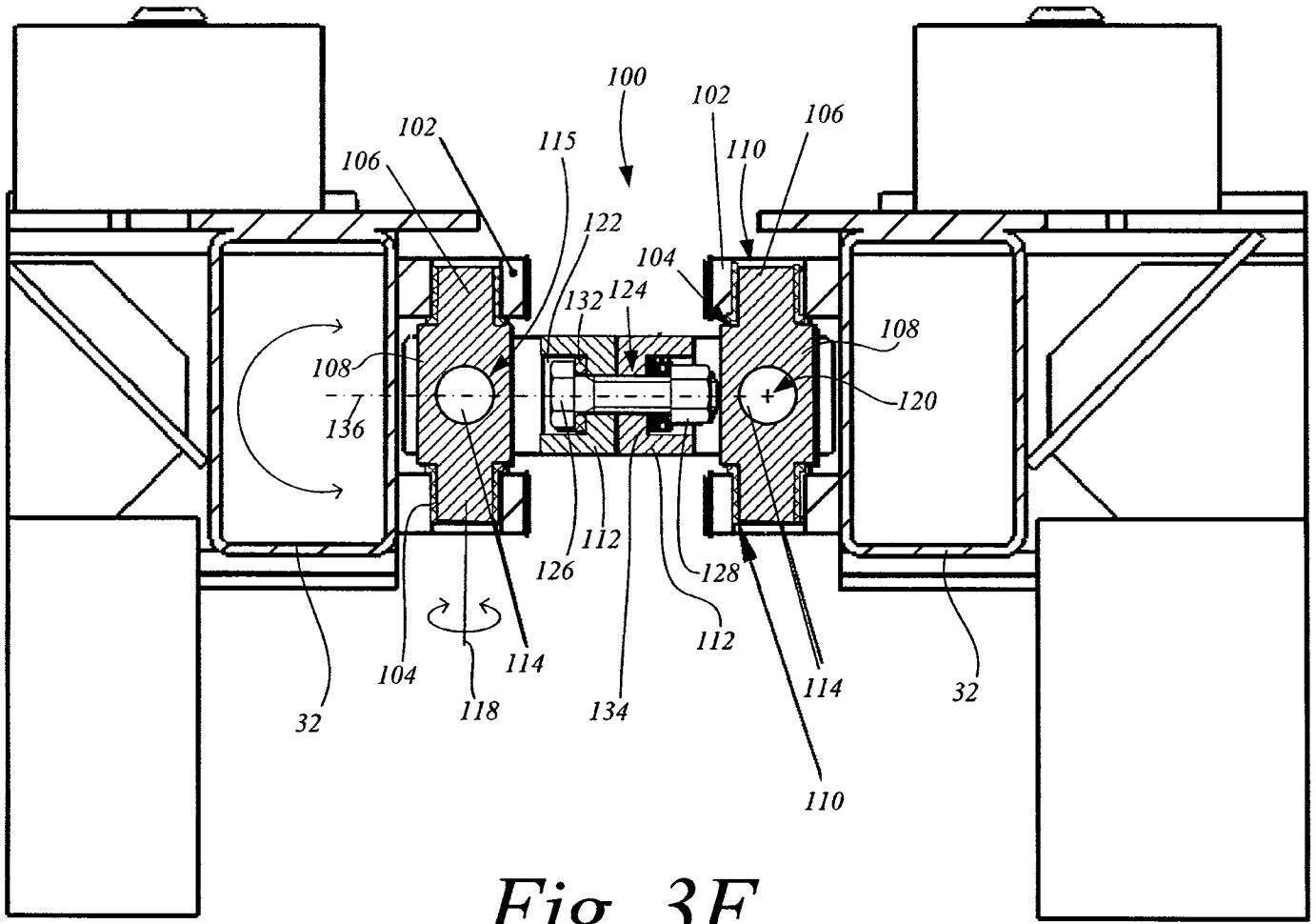
FIG. 3F is a cross section of a connector arrangement disposed to connect the two lower frames shown in FIGS. 3C-3F, which includes an extendible center pin in accordance with the disclosure.
Figure 3G:
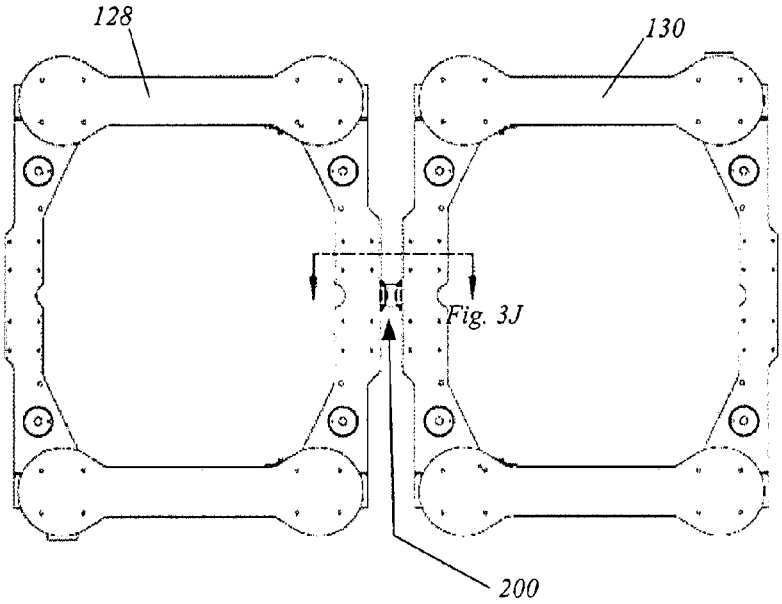
FIGS. 3G and 3H are outline views from, respectively, the top and side of a third embodiment of the connection between the lower frames in accordance with the disclosure.
Figure 3H:
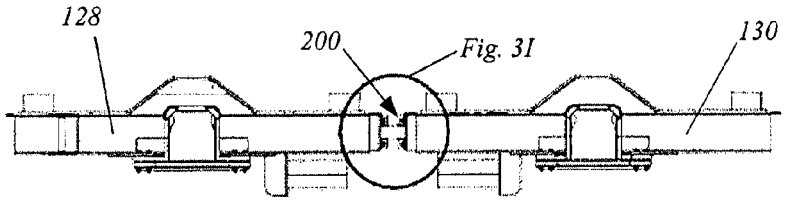
Figure 3I:
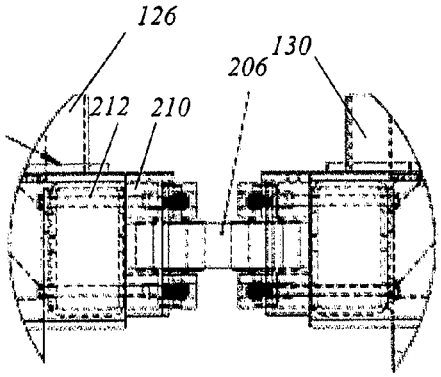
FIGS. 3I and 3J are, respectively, a detail view and a section view of the third embodiment.
Figure 3J:
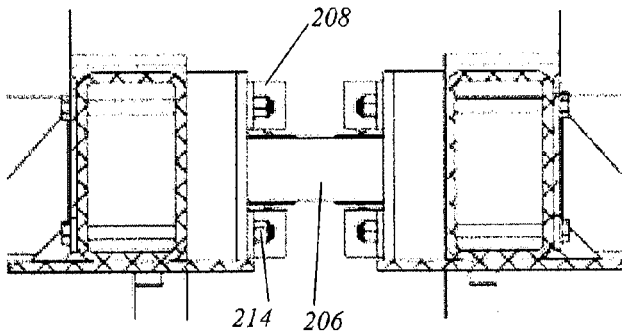

Two additional types of motion freedom are provided in the connection between two yokes or center link pin retainers 112. In the illustrated embodiment, the two yokes 112 form corresponding pockets 122 and fastener openings 124, which are aligned coaxially with one another as best shown in FIG. 3F. A bolt 126 passes through the aligned fastener openings 124 to connect the two yokes 112 by use of a nut 128, which in the illustrated embodiment is a lock-type nut arranged to retain an engagement torque with a threaded portion of the bolt 126. A washer 132 is disposed between the bolt 126 and one of the yokes 112, and one or more resilient washers 134, which are commonly known as Belleville washers, are disposed between the nut 128 and the second yoke 112.

The bolted connection between the two yokes 112 maintains a correct spacing or distance between the lower frame weldments 128 and 130 when travelling along a straight track, and further provides two additional freedoms of motion between the yokes 112. One can appreciate that the resilient washers 134 may respond to a force tending to pull apart the two yokes 112 during, for example, acceleration along the track, by becoming compressed, thus providing a limited extent of axial displacement spreading the yokes 112 apart along a longitudinal axis 136 of the bolt 126. The non-rigid connection of the yokes 112 provided by the resilient washers 134 also provides the capability of relative rotation between the yokes 112 about the longitudinal axis 136 of the bolt 126. The axial displacement and rotatable motion of the yokes 112 along and about the longitudinal axis 136 of the bolt 126, which in large part is provided by the resilient washers 134, constitute the two additional degrees of freedom of motion between the two yokes 112.

The motion of the intermodal vehicle is such that the two frame weldments may be at different angles such as during turning or different elevations such as cresting a hill. Moreover, the interconnection between the two lower frame weldments may be subjected to various stresses, forces, and moments during operation, such as those imparted when traversing curved track, braking, accelerating, connecting rail cars, and so forth. The four degrees of freedom of motion between the two lower frame weldments provided by the gimbaled connection arrangement 100, which include rotation about three orthogonal axes as well as axial motion along a longitudinal axis of the arrangement 100, provide an improvement in reliability, resistance to wear, and generally improved operation over known designs. In one aspect, the gimbaled connection arrangement provides the capability of extension of the link between the two lower frame weldments along the axis of the bolted connection with restraint in pitch, yaw, or roll.

In both embodiments shown in FIGS. 3 through 3F, the "A" lower frame weldment differs from the "B" lower frame weldment in that it has upper and lower spaced apart coupling plates 37 and the aforementioned guide weldment 36. In the first embodiment, when the two lower frame weldments are coupled to each other, the coupling pin is inserted within the aligned apertures in coupling plates 37 and bushing 39 and held in place by pin 40.1. It should be noted that coupling plates 37 touch a wearplate on the cross channel of lower frame weldment 30 and the coupling plate 32 touches the wearplate on the cross channel of lower frame weldment 28. Additionally, and as part of the connection of the two lower frame weldments above described, two urethane "Tekspak" bumpers 41 as manufactured by S. W. Miner Co. and best shown in FIG. 3 are mounted near each outer end of cross channel of lower frame weldment 28. In the second embodiment, which is shown in FIGS. 3C-3F, the two frame weldments can be identical or substantially similar in structure.

The disclosure further provides a third improved embodiment of a bogie having an elastomeric connection in the form of an improved center link 200 between the two lower frames, as shown in FIGS. 3G through 3L. The elastomeric design of the centerlink 200 further reduces the impact forces imposed on the link components by allowing compliance in three rotational dimensions and one linear dimension as in the second embodiment.

Figure 3K:
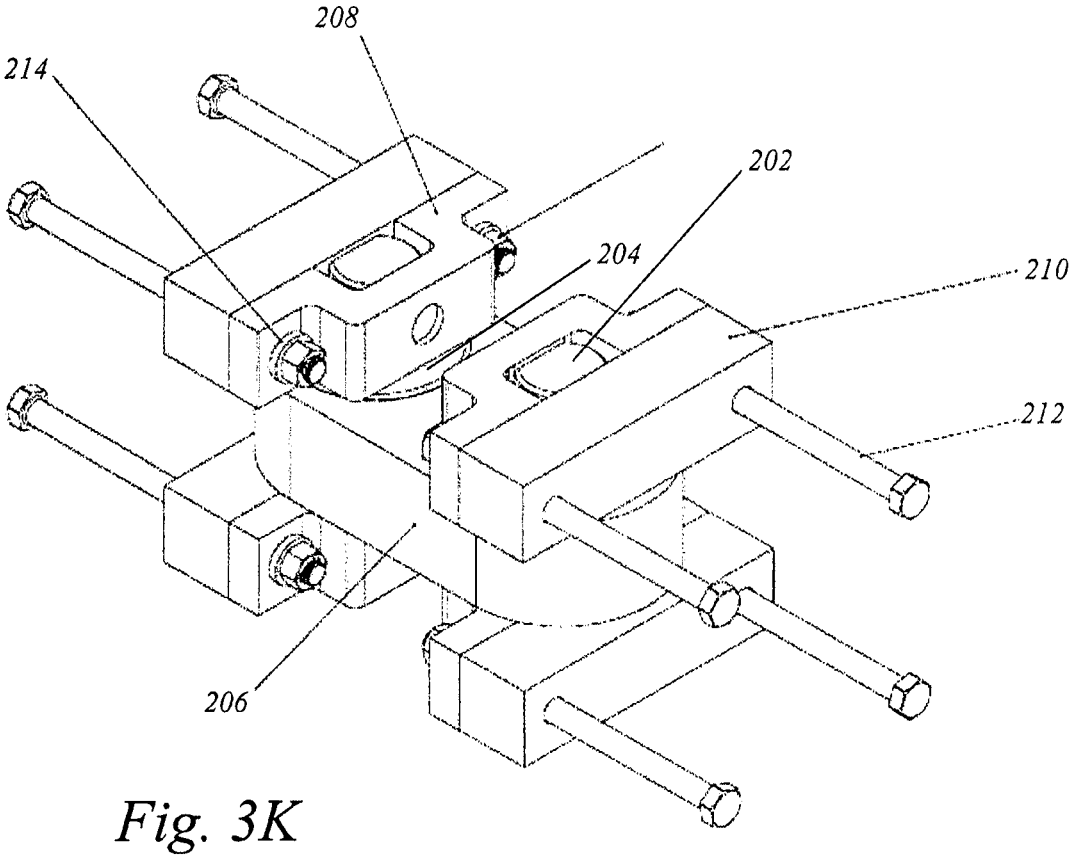
FIG. 3K is an outline view of the third embodiment for a gimbaled connection shown with surrounding components removed for clarity.
Figure 3L:
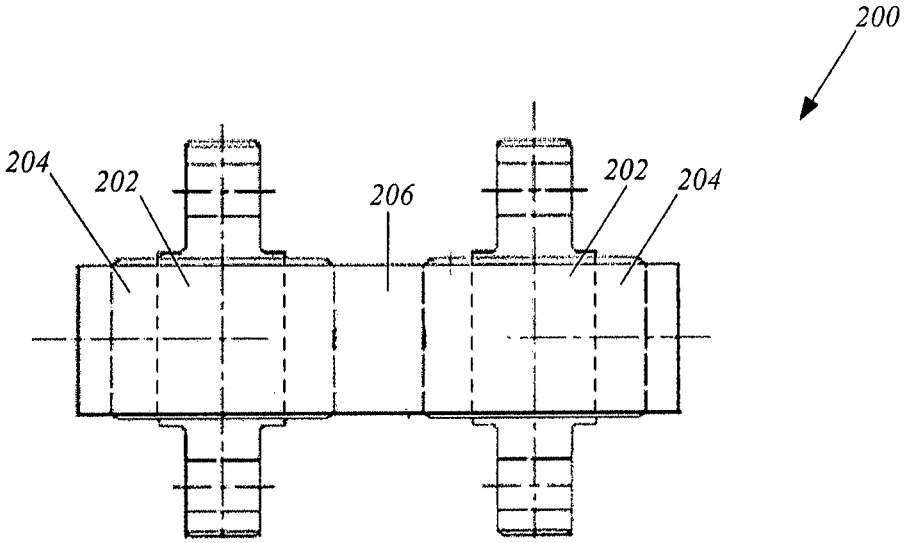
FIG. 3L is an outline view of an elastomeric member in accordance with the disclosure.

In reference to FIGS. 3K and 3L, the improved center link 200 includes one or more vertical reaction rods 202 secured inside rubber bushings 204 of a specified spring rate. These bushings 204 are mounted inside a pillow block 206. The ends of each reaction rod 202 is bolted to the respective lower frame by a bracket having two pieces 208 and 210 surrounding the reaction rod 202 and connecting the same in a pivoting fashion to the lower frames by long fasteners 212. The fasteners include nuts 214 securing the bracket pieces.

The improved centerlink 200 allows the lower frames to move in an independent manner in rotation in pitching, rolling, yawing, and longitudinal extension. Restoring forces are provided by the resilient return forces resisting deformation of the rubber bushings 204, which act as springs and also as dampers. In other words, the rubber bushings 204 hold the vertical reaction rods 202 in place as well as the existing elastomeric pads disposed between the two lower frames, as previously described. The resilient nature of the rubber bushings 204 advantageously provides a restoring force tending to bring the two lower frames in alignment. This restoring force, coupled with the damping effect of the bushings 204, reduces or eliminates the hunting of the wheel sets, yet also provides an axial force that resists the separation of the two lower frames under braking.

The design of the centerlink of the third disclosed embodiment will allow for self steering in curves as small as 150 ft. (about 46 meters), while also further improving the bogie's ability to negotiate track or rail bed irregularities. The reaction rods 202 and rubber bushings 204 are each attached to a respective lower frame, thus allowing each frame to move laterally, pitch relative to one another, and rotate relative to one another. Rotation is enabled by the elasticity of the rubber bushings 204. This increase in flexibility at the centerlink 200 as compared to existing designs reduces or eliminates wear of the components and directs the motion of the lower frames into bushings and shafts that are designed to accommodate such motion as well as withstand the resulting forces.

The additional compliance at the centerlink also reduces wear on the pins at the elastomeric shear pads. In the first embodiment, the pins are required to withstand the forces generated by the movement between the rigid upper frame and the longitudinally rigid and minimally flexible pitching action created by the center pin, bushing, and clevis arrangement. By allowing more deflection at the centerlink in accordance with the second embodiment, lower deflection and, thus, lower forces occur at the shear mounts. The total deflection is controlled by the spring elements. In order to guarantee that sufficient resistance to the application of the brakes is always available, the springs or spring members are sized to resist the full brake force. Should more force be applied, the springs will reach their solid height providing a positive limit to travel. The third embodiment is even more effective at allowing deflection and decreasing the forces occurring at the shear mounts. The rubber bushings in the elastomeric centerlink will have a specified spring rate that leaves them capable of withstanding the full brake force.

The elastomeric centerlink design of the third embodiment retains the bolted connection to the two lower frames described in the second embodiment.

Two air springs 90 are provided. The springs are Firestone no. 148-1, which have a load capacity of approximately 56,000 lbs (about 25,400 kg.) at an air pressure of 80 p.s.i. (about 552 kPa). In this invention, the springs, with a bead ring are fastened to the upper mounting plates 57 of the upper frame and to a lower plate with a central downward projecting bolt which is supported by and pivoted from mounting plates 35 of the lower frames. When air is introduced into the air springs, the upper frame assembly will rise and lift the superimposed trailers. When air is evacuated from the air springs, the upper frame will descend so that the superimposed trailers may by removed and different trailers positioned thereon.

Figure 7:
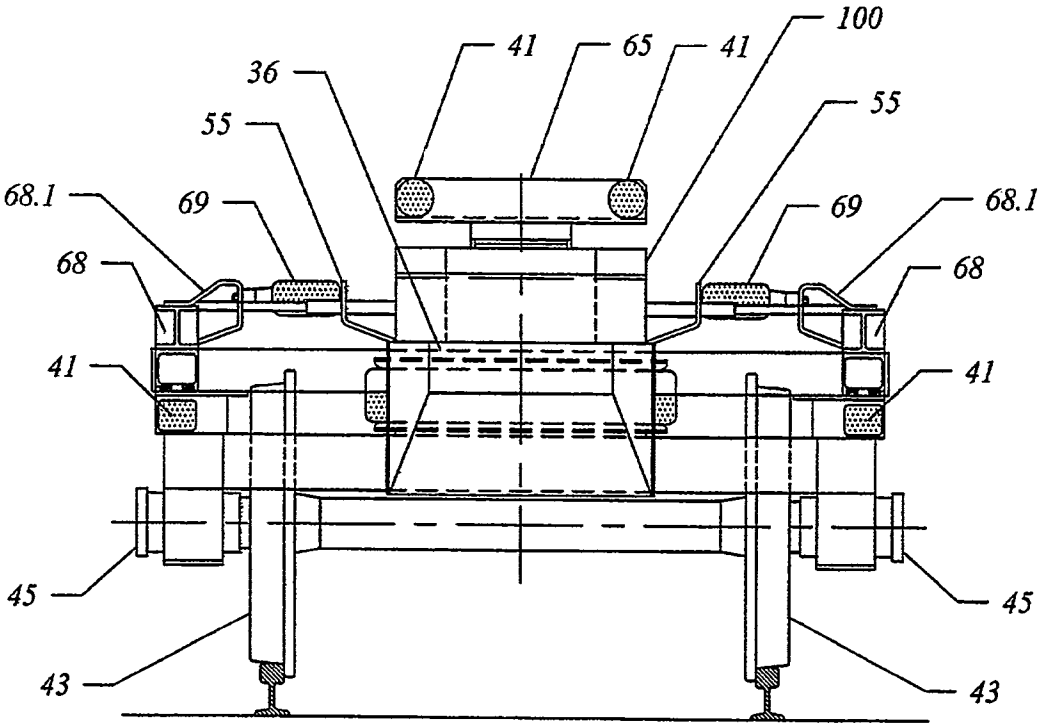
FIG. 7 is a view of the "A" end of the vehicle.

Each of the "A" end and "B" end lower frame weldments receive a rail wheel assembly 42, all rail wheel assemblies being identical, and each of the rail wheel assemblies having spaced apart rail wheels 43 carried by a live axle 44. The live axle 44 is rotatable relative to the lower frame weldments about an axis of rotation 46 that coincides with the longitudinal axis of the axle 44. The ends of axle 44 are received within suitable bearing assemblies 45 of conventional design. The bearing assemblies are mounted within each of the lower frame weldments. It can be seen that the two lower frame weldments and wheel assemblies form a portion of a steerable rail truck. In the embodiment shown in FIGS. 3C-3F, each of the lower frame weldments can pivot, twist and/or rock as a result of the degrees of freedom provided by the novel connector arrangement 100 disclosed herein. Each side frame weldment 31 includes three urethane "Tekspak" bumpers 41, the function of which will be described later herein. Referring to FIG. 7, the rear view of the intermodal vehicle is shown at the "A" end, with the guide assembly 36 clearly visible. The guide, as mentioned before, assists the trailer in backing upon the intermodal vehicle by centering it as it "climbs" the ramped end of the upper frame. When the intermodal vehicle is raised, the trailer frame members no longer touch the guide.

Figures 4, 4A:
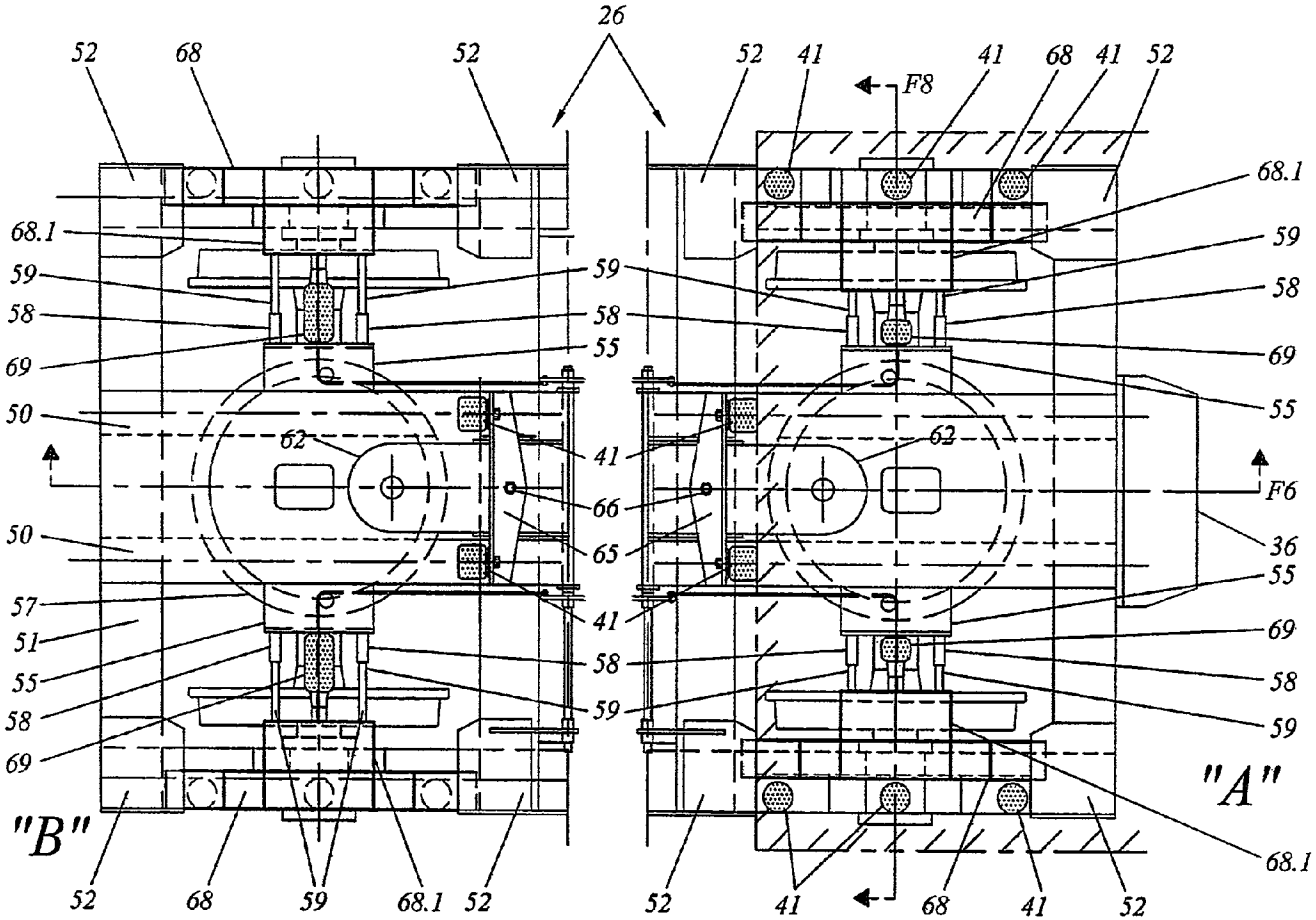
FIG. 4 is a part plan view of the top frame in the running position.
FIG. 4A is a part plan view of the top frame in the retracted position.
Figure 5:
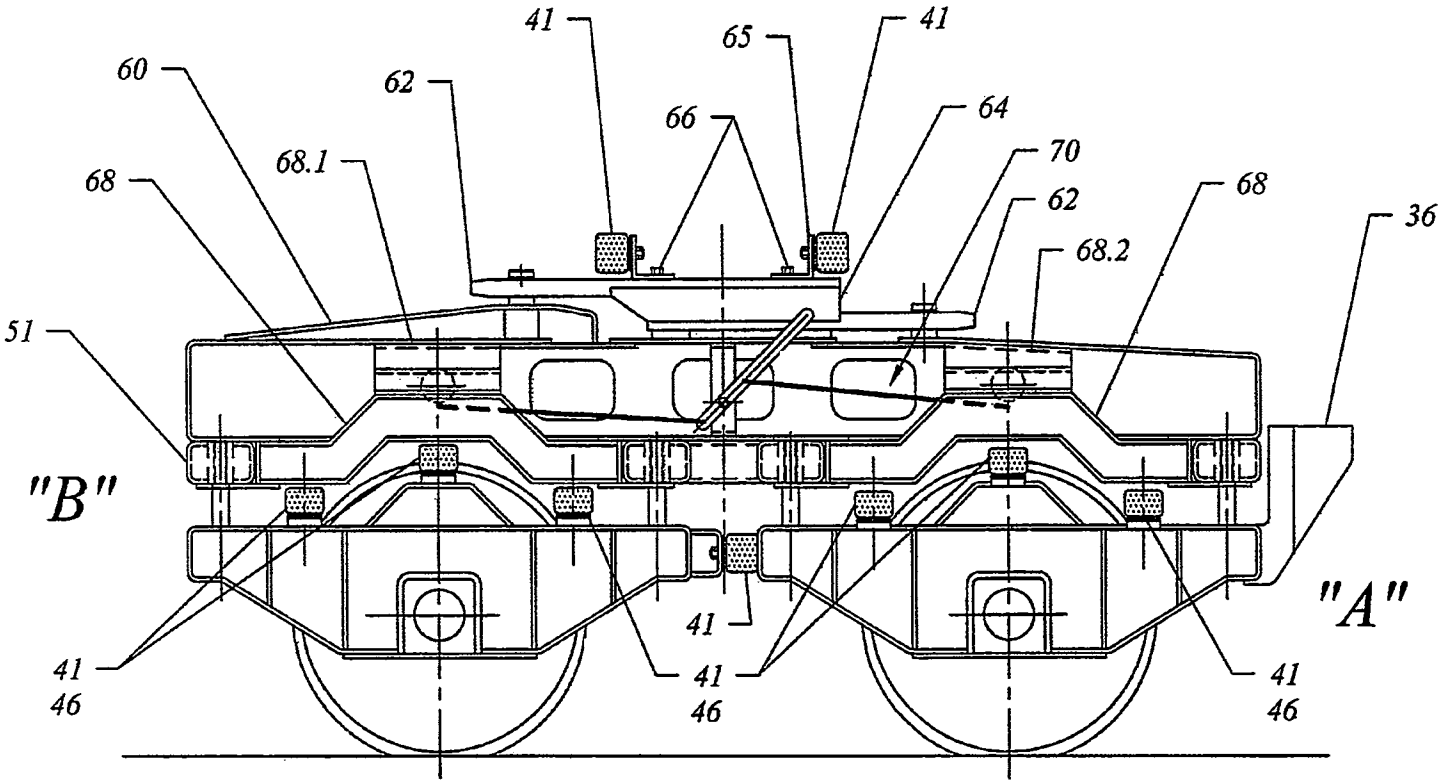
FIG. 5 is a side view of the vehicle in the raised position.
Figure 5A:
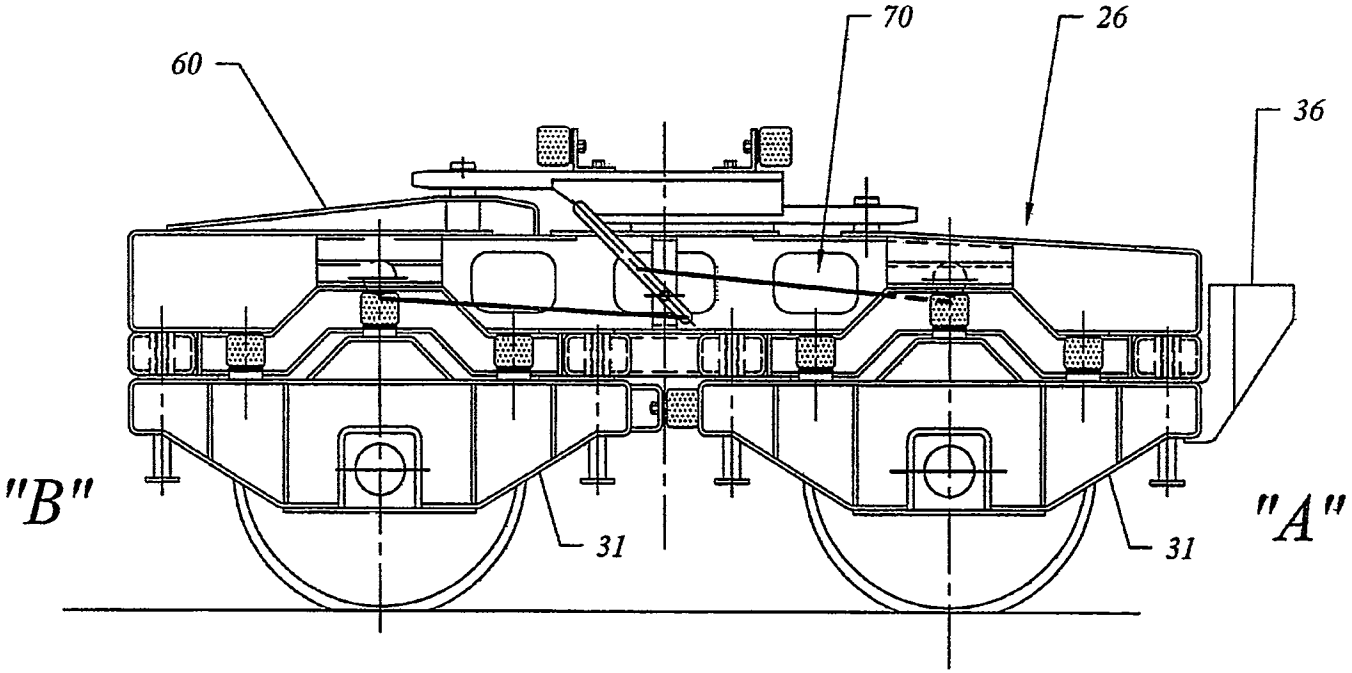
FIG. 5A is a side view of the vehicle in the retracted position.
Figures 6, 6A:
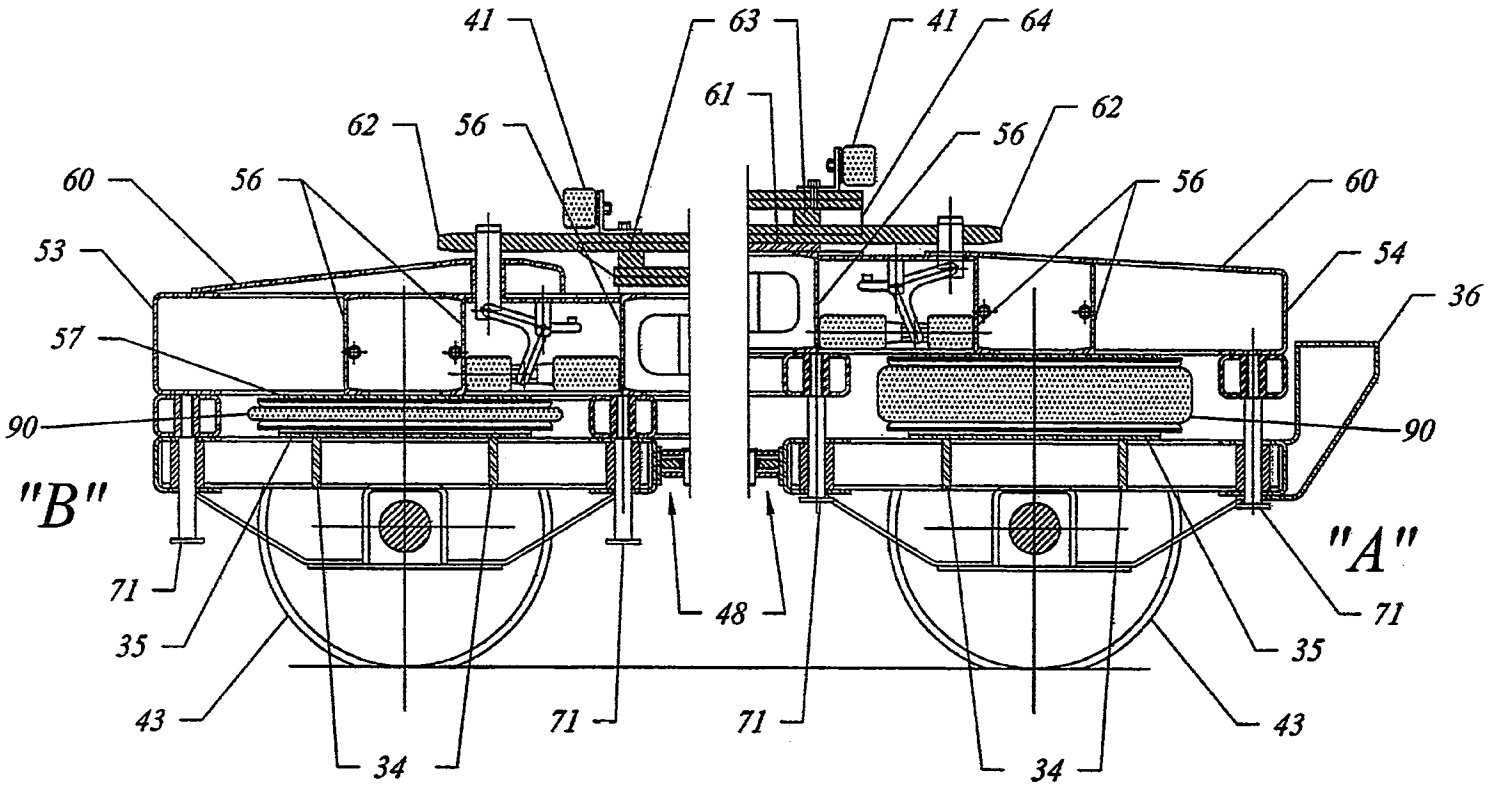
FIG. 6 is a longitudinal section of the vehicle in the raised position.
FIG. 6A is a longitudinal section of the vehicle in the retracted position.

With reference to FIGS. 4 and 4A, the upper frame weldment 26 is shown in plan view and is shown also in FIGS. 6 and 6A in sectional elevation. The main components of the upper frame weldment are two longitudinal "I section" beams 50, four crossmembers 51 of structural tubing, guide plates 52, sixteen in number, are attached to the outer ends at the top and bottom of the crossmembers. End channels 53 and 54 are provided at the outer ends of the beams 50. Four brackets 55, for mounting the operating cylinders are attached to beams 50. Interior crossmembers between the longitudinal beams are provided for mounting the coupler pin operators and to support the airspring mounting plate 57. Tubes 58 for directing guide rods 59 are provided. Support plate 60 is fastened to the "B" end of the upper frame for supporting the front end of a trailer, while at the "A" end of the upper frame, the longitudinal beams 50 are ramped to guide and support the rear of a trailer. Plate 61 for mounting the coupler assembly spans the longitudinal beams as is better shown in FIG. 6. The coupler assembly 26.1 is a weldment comprised of two coupler tongues 62, two spacers 63 and gussets 64. At the top of the assembly weldment, angle brackets 65 are pivoted by mounting bolt 66 from the upper coupler tongue. At the outer ends of the angle brackets, "Tekspak" bumpers 41 are mounted. This arrangement provides pressure against the end of the trailer during rail travel to cushion any slack in the coupling. At the center of each cross tube, a threaded block 67 is provided into which a vertical steering return bar is threaded. This arrangement is better shown in FIGS. 11, 12 and 13. As is shown in plan in FIGS. 4 and 4A and in elevation in FIGS. 5. and 5A, pressure bars 68, four in number, slide in and out between the guide plates 52. When the pressure bars are in the outward position, the running position when operating on the tracks, they prevent the upper frame assembly from lowering. When in the inward position, the position for train make-up and break-up, they allow the upper frame to lower. As previously described, in FIG. 8, pressure bar 68 is directly above the urethane bumper 41, thus preventing the lowering of the upper frame of the intermodal vehicle, in FIG. 8A, the pressure bar 68 is shown in the inward position, thus allowing the upper frame of the intermodal vehicle to be lowered as shown.

Figures 8, 8A:
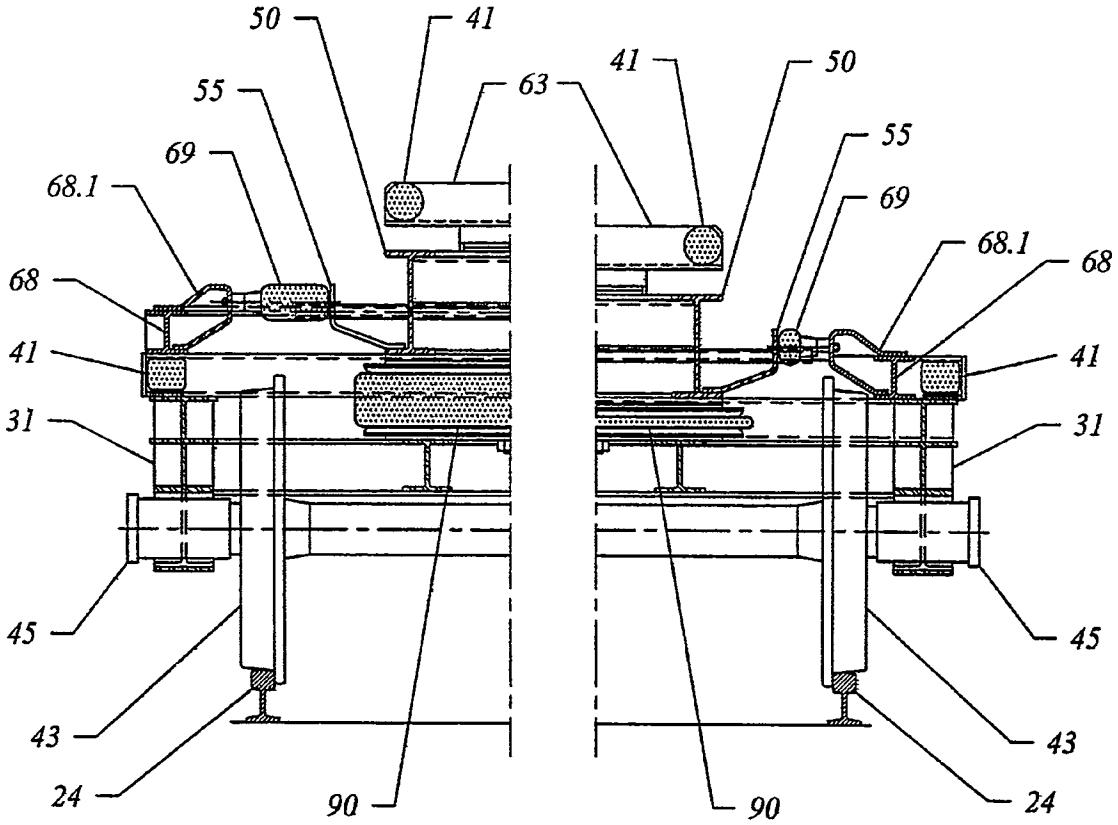
FIG. 8 is a partial cross-section of the vehicle in the raised position.
FIG. 8A is a partial cross-section of the vehicle in the retracted position.

The operation of the pressure bars outward is by air actuators 69 as manufactured by Firestone Industrial Products operating against a bracket 68.1 attached to the pressure bar and inward by a cable arrangement shown generally as 70. Guide rods 59 attached to the pressure bar brackets 68.1 operate within the aforementioned guide tubes 58. As an alternate, a double acting cylinder may be used in lieu of the air actuators and cable arrangement. Referring to FIGS. 8 and 8A, the pressure bars 68 are shown in both the in and out positions.

Figure 11:
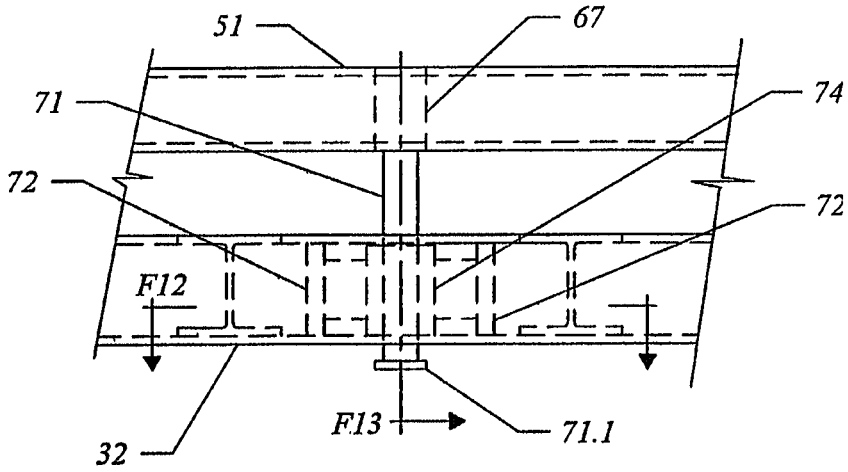
FIG. 11 is a view of the steering return spring.
Figure 12:
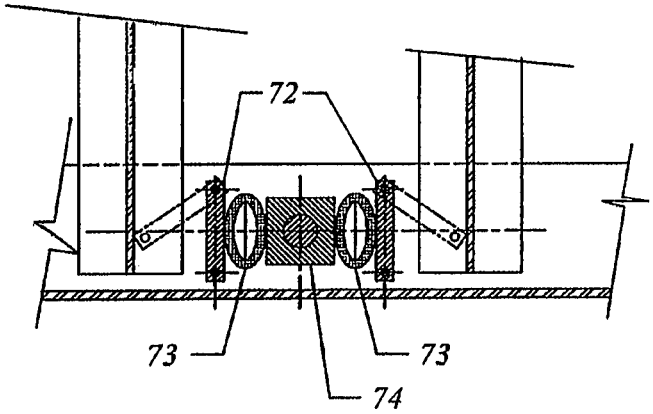
FIG. 12 is a section through the steering return spring.
Figure 13:
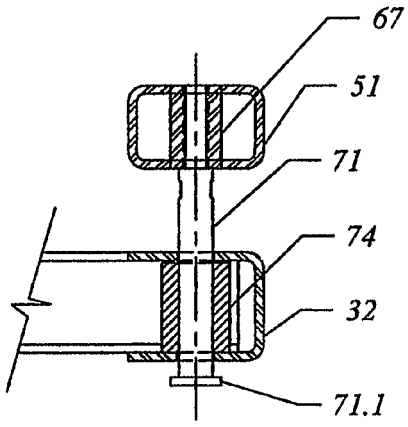
FIG. 13 is a section through the steering return spring.

Referring now to FIGS. 11, 12 and 13 which show the steering return scheme. Threaded block 67 is fastened to crossmember 51 of the upper frame at its center. In the transverse channel 32 of the lower frame, swinging stop bars 72 are provided. A loose block 74 having a vertical hole rests between two tubular urethane spring members 73 which are fastened to the block. The vertical steering bar 71 passes upward through the channel 32 and the block 74 and is threaded into threaded block 67. The vertical steering bar 71 has on its lower end a flange 71.1 which serves as a limit to prevent the upper frame from being lifted high enough so it becomes detached from the lower frames. When the vertical steering bar is thus attached to the upper frame, the swinging stop bars 72 are swung into their proper position and put pressure on the tubular spring members 73.

Figure 9:
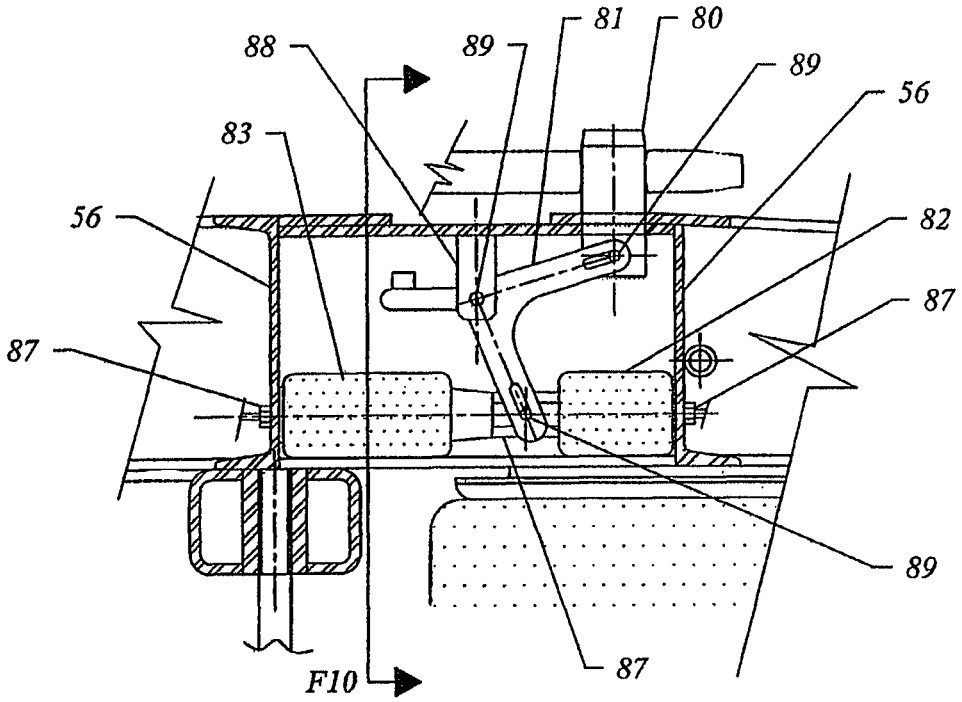
FIG. 9 is an enlarged view of the coupling pin operating mechanism.
Figure 10:
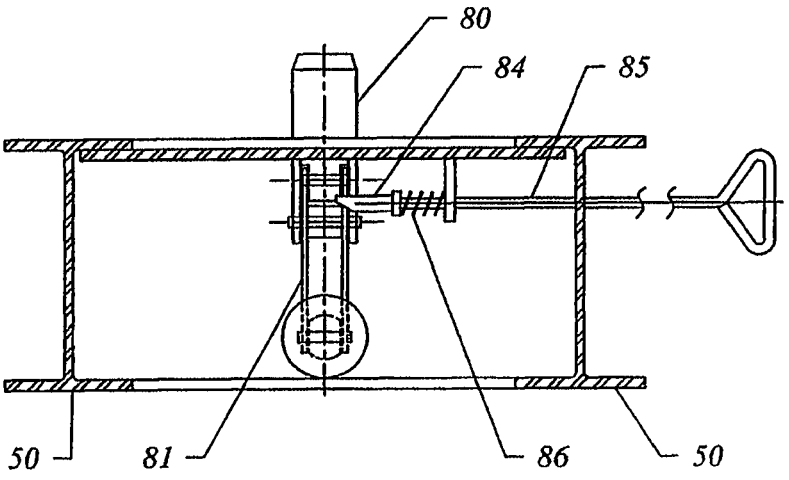
FIG. 10 is a cross-section of the coupling pin operating mechanism.

With reference now to FIGS. 9 and 10 which show enlarged views of the coupling pin operating mechanism shown in FIGS. 6 and 6A. Thus, the coupling pin 80 is supported, raised and lowered by spaced apart bell crank levers 81 activated by rubber actuators 82 and 83, as manufactured by Firestone Industrial Products Company, fastened to crossmembers 56 transverse to the intermodal vehicle upper frame members so that when air is introduced in one actuator and evacuated from the other actuator, the bell crank levers will raise or lower the coupling pin 80. Air is introduced into the actuators through hollow mounting bolt 87 which has threads on its outer surface for bolting the rubber actuator to the frame crossmembers 56 and also has internal threads to provide a means for attaching the appropriate fitting for the air inlet. The levers 81 are pivoted from bracket 88 and cylinder connector block 87 by pivot pins 89. A safety latch 81 attached to handle 85 and held in place by spring 86 engages one of the levers 81 to prevent the coupler pin from descending until manually released.

Figure 14:
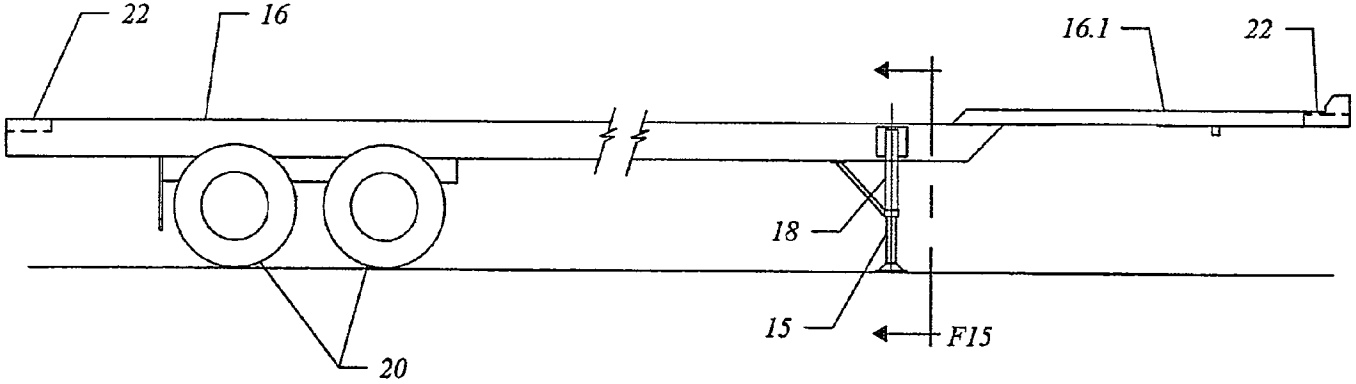
FIG. 14 is a side view of a trailer equipped to carry ISO containers.
Figure 15:
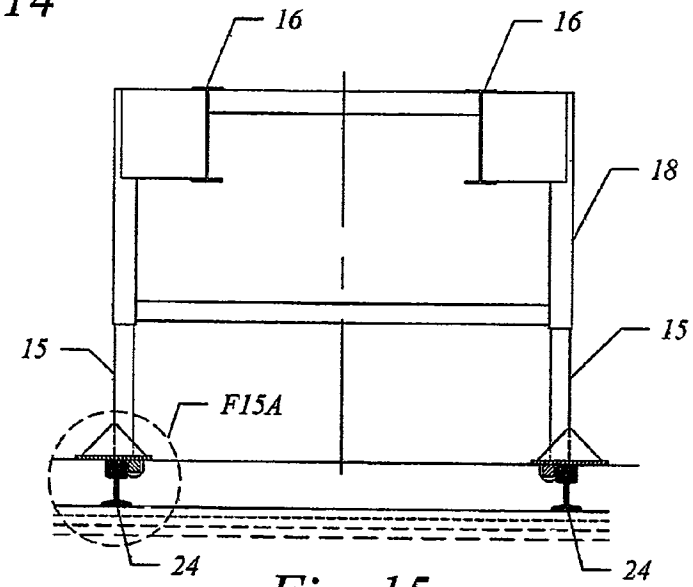
FIG. 15 is a view of the trailer landing gear.
Figure 15A:
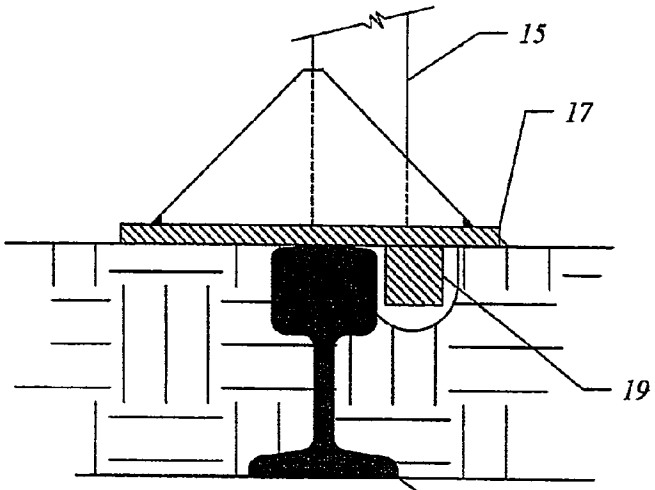
FIG. 15A is an enlarged view of the trailer landing gear base shoe.

Refer now to FIGS. 14 and 15 which show a typical trailer for transporting ISO containers. The trailer in FIG. 14 is comprised of (two) longitudinal beams 16 reinforced by multiple crossmembers (not shown) with a gooseneck at its forward end 16.1 and coupler sockets 22 at each end for coupling to the intermodal rail vehicle. Attached near the rear end of the trailer are tandem axles with wheels 20 and near the front end of the trailer a landing gear assembly is affixed. FIG. 15 shows the landing gear assembly fastened to the trailer frame members 16. Legs 15 telescope into tubes 18 by an arrangement of gears (not shown). Legs 15 have at their bottom ends, shoes 17, at the lower end of which are lugs 19, shown in FIG. 15A. These lugs are situated in a way that they will straddle the tracks near their inner edges, thus centering the trailer to the intermodal vehicle.

Train Make-Up Procedure

With reference now to FIGS. 1 and 2, an intermodal train of this invention is made up as follows. Initially a trailer will be positioned on the railroad track, with its front end facing the operation; the trailer can be aligned to the track by the lugs 19 on the landing gear legs 15. The intermodal vehicle is placed on the track with the "B" end facing the front of the trailer.

Then the brakes on the trailer are set and the landing gear legs raised or lowered as required so that the intermodal vehicle can be pushed under its front end and the coupling tongue 62 on the intermodal vehicle enters the coupling socket 22 on the trailer. The rear end of the second trailer is pushed toward the "A" end of the intermodal vehicle; the bottom of the coupler socket of the trailer climbs the ramped end of the longitudinal beams 50 of the upper frame of the intermodal vehicle and is centered by the contact of the inner flange surface of the trailer frame rails 16 to the guide 36 on the lower frame of the intermodal vehicle until the coupler tongue 62 of the intermodal vehicle enters the coupler socket 22 on the rear end of the trailer. When the trailers are in position atop the intermodal vehicle, air can be introduced into the coupler pin actuators to raise the pins and into the air springs to raise the trailers for railroad operation. The foregoing steps will be completed with other intermodal rail vehicles and highway trailers until a suitable train is formed.

An Automatic Coupler

Figure 16:
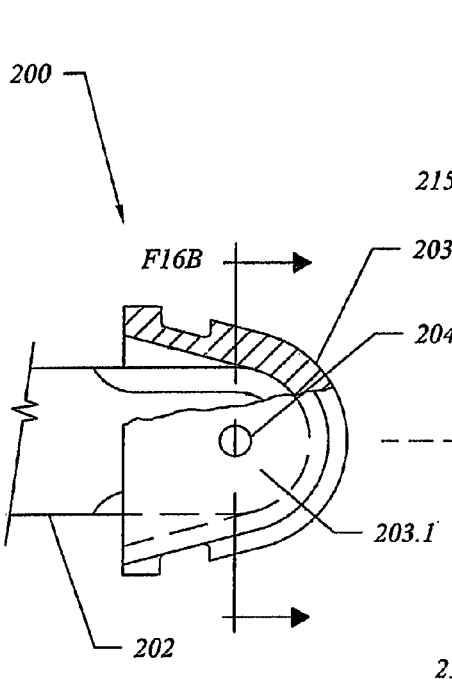
FIG. 16 is a plan view of the male coupler portion of an auto-coupler.
Figure 16A:
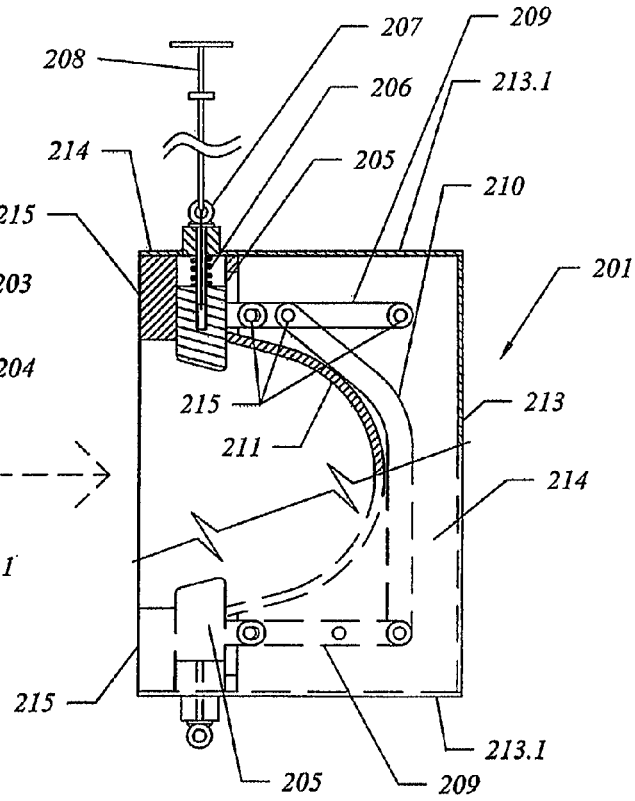
FIG. 16A is a plan view of the trailer socket during coupling operation.
Figure 16B:
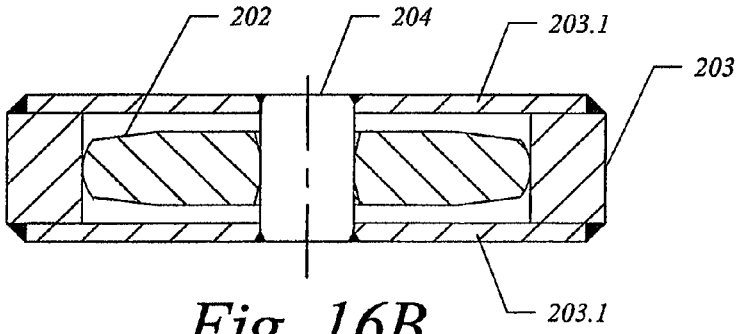
FIG. 16B is a cross-section of the male portion of the auto-coupler.
Figure 17:
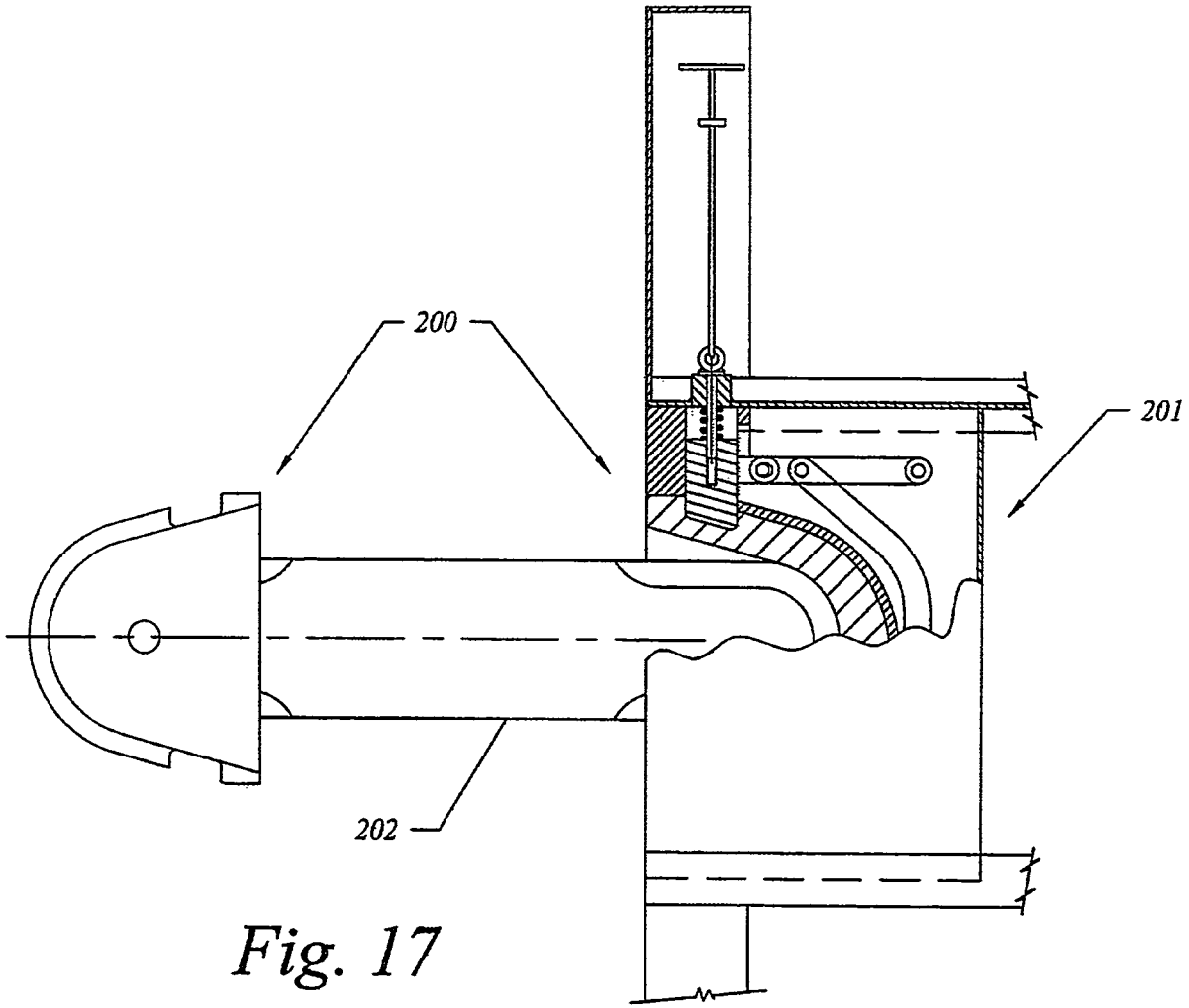
FIG. 17 is a plan view of auto-coupler in the coupled position.

As an alternate to the coupling method described above, it may be advantageous that an automatic coupling system be provided, especially for use with short, so called "sprint trams". Referring now to FIGS. 16, 16A, 16B and FIG. 17 which show an automatic coupler. FIG. 17 shows a unique female coupler socket 201 in the rear of a trailer and the corresponding male ends 200 attached to the top of the intermodal vehicle. FIG. 16 shows the detail of the male coupler end which is comprised of an outer contoured element 203 with an upper and lower cover plate 203.1, the combination of which is pivoted by pin 204 on coupler tongue 202. The aperture on tongue 202 into which the pin fits is "hourglass-shaped". That is, the upper and lower thirds of the opening are tapered so that the tongue can "rock" from side to side; additionally, the coupler tongue has a similar taper at its sides, and rounded edges where it contacts the inner surface of element 203. The male coupler end fits into the trailer socket 201 and specifically against inner surface 211. The coupler socket has two lugs 205 which are urged inward of the female socket assembly by springs 206. The two lugs are interconnected by a system of levers 209 and 210, pinned together by pins 215 and which may be operated outward by handle 208 connected to eyebolt 207. All of the above listed elements are enclosed within a "box" comprised of side members 213.1, end member 213, pressure block 215 and top and bottom plates 214, all of which making a box four inches thick and 35.5 inches wide installed between the frame members 16 at the rear and at the front of a trailer.

In the train make-up operation, the "B" end of the intermodal vehicle is pushed into the socket at the front end of a trailer and into the rear end of a second trailer as described in the above trailer make-up procedure. As male ends enter the female coupler sockets, they displace the lugs 205, which snap into the depressions on the contoured element 203 of the male end assembly thus effecting a coupling of the intermodal rail vehicle to the trailers. To disengage the couplers from the trailers, it is necessary to release the lugs by pulling on release lever 208, which releases both lugs through the interconnecting levers.

What is claimed is:

1. An improved intermodal rail vehicle to form a train of highway trailers including leading and trailing highway trailers, which are interconnected to each other and supported by the intermodal vehicle for travel on railroad tracks, each of the highway trailers including a leading coupler socket assembly at one end and a trailing coupler socket assembly at the other end, each intermodal rail vehicle having two rail wheel assemblies, two lower frame assemblies into which each of the two rail wheel assemblies are mounted, an upper frame assembly supported on the lower frame assemblies by integral air springs, the upper frame including leading and trailing load carrying structures characterized by the provision of:

an integral drawbar assembly mounted on the upper frame assembly and extending above the leading and trailing load carrying structures, each end of the assembly of an associated highway trailer supported on an associated load carrying structure to connect the associated trailer to the intermodal vehicle;

wherein the drawbar assembly has a high and a low end;

wherein the high end is adapted for entry into the front trailer coupler socket; and wherein the low end is adapted for entry into the rear trailer socket;

such that the trailers, when coupled to the intermodal rail vehicle, will run parallel to the track;

an improved coupling between the lower frames, the coupling including:

a set of plates connected to each of the lower frames and extending between the two lower frames;

a set of vertically aligned openings formed in the set of plates;

a vertical tapered bushing connected to one of the plates and forming a central opening in alignment with the set of vertically aligned openings;

a vertical pin disposed through the set of vertically aligned openings and within the central opening of the tapered bushing; and two urethane bumpers connected on one of the lower frames and disposed between the two lower frames.

2. An improved intermodal rail vehicle to form a train of highway trailers as set forth in claim 1, further including two angle brackets pivotally mounted on the leading and trailing load carrying structures, and urethane spring bumpers mounted at outer ends of each of the two angle brackets, such that the bumpers exert a pressure upon the ends of the trailers when coupled to control slack in the coupling between the leading and trailing load carrying structures and the coupler sockets of the trailers.

3. An improved intermodal rail vehicle to form a train of highway trailers as set forth in claim 2, further characterized by the provision of:

four vertical bars, each vertical bar disposed along a longitudinal centerline of the intermodal rail vehicle and connected by a respective fitting to the upper frame assembly and spaced so that one vertical bar is positioned over each of four end channel crossmembers forming respective leading and trailing portions of each of the lower frames;

four blocks, each block disposed within a respective channel defined by each end channel crossmember and forming a hole through which each vertical bar passes;

two urethane springs are connected to each channel crossmember and disposed one on each transverse side of each block such that each block is allowed to move transversely relative to each channel crossmember when the lower frames steer along the track; and a flange formed at the bottom of each vertical bar, the flange contacting a bottom of the lower frames thus defining a maximum travel height of the upper frame relative to the lower frames and enabling lifting of the entire intermodal rail vehicle by engaging and lifting the upper frame.

4. An improved intermodal rail vehicle to form a train of highway trailers as set forth in claim 1, further characterized by the provision of:

a sloped ramp defined at either end of the upper frame assembly; and a guide assembly mounted upon the lower frame directly below each sloped ramp;

wherein each guide assembly guides and centers each trailer relative to the intermodal rail vehicle as each trailer is ramped upward to rest upon and engage the upper frame assembly.

5. An improved intermodal rail vehicle to form a train of highway trailers including leading and trailing highway trailers, which are interconnected to each other and supported by the intermodal vehicle for travel on railroad tracks, each of the highway trailers including a leading coupler socket assembly at one end and a trailing coupler socket assembly at the other end, each intermodal rail vehicle having two rail wheel assemblies, two lower frame assemblies into which each of the two rail wheel assemblies are mounted, an upper frame assembly supported on the lower frame assemblies by integral air springs, the upper frame including leading and trailing load carrying structures characterized by the provision of:

an integral drawbar assembly mounted on the upper frame assembly and extending above the leading and trailing load carrying structures, each end of the assembly of an associated highway trailer supported on an associated load carrying structure to connect the associated trailer to the intermodal vehicle;

wherein the drawbar assembly has a high and a low end;

wherein the high end is adapted for entry into the front trailer coupler socket; and wherein the low end is adapted for entry into the rear trailer socket;

such that the trailers, when coupled to the intermodal rail vehicle, will run parallel to the track;

a gimbaled coupling arrangement, comprising:

a bearing block connected to one of the two lower frame weldments;

a central connection pin rotatably connected to the bearing block and extending parallel to an axis of rotation of the respective rotatable axle;

a bearing pin extending through a mid-portion of the central connection pin and having a longitudinal axis that is substantially parallel to the axis of rotation of the respective rotatable axle;

a yoke rotatably connected to the bearing pin and forming a fastener opening extending perpendicular to the longitudinal axis of the bearing pin;

a fastener disposed through the fastener opening and connecting the yoke to the other of the two lower frame weldments;

a resilient element disposed between the fastener and the yoke, the yoke being in contact with a portion of the other of the two lower frame weldments when the resilient element is in a first compressive state and at a predetermined distance therefrom when the resilient element is in a second compressive state.

6. An improved intermodal rail vehicle to form a train of highway trailers as set forth in claim 5, further characterized in that the gimbaled coupling arrangement comprises:

an additional bearing block connected to the other of the two lower frame weldments;

an additional central connection pin rotatably connected to the additional bearing block and extending parallel to an axis of rotation of the respective rotatable axle;

an additional bearing pin extending through a mid-portion of the additional central connection pin and having a longitudinal axis that is substantially parallel to the axis of rotation of the respective rotatable axle;

an additional yoke rotatably connected to the additional bearing pin and forming an additional fastener opening extending perpendicular to the longitudinal axis of the additional bearing pin;

wherein the fastener is disposed through the additional fastener opening and connects the yoke with the additional yoke.

7. An improved intermodal rail vehicle to form a train of highway trailers as set forth in claim 5, wherein the central connection pin provides a yawing capability of motion between the two lower frame weldments during operation about an axis that is perpendicular to the axis of rotation of the respective rotatable axle.

8. An improved intermodal rail vehicle to form a train of highway trailers as set forth in claim 5, wherein the bearing pin provides a pitching capability of motion and enables the yawing capability of motion between the two lower frame weldments during operation about an axis that is parallel to the axis of rotation of the respective rotatable axle.

9. An improved intermodal rail vehicle to form a train of highway trailers as set forth in claim 5, wherein the fastener provides a rolling capability of motion between the two lower frame weldments during operation about an axis that is perpendicular to the axis of rotation of the respective rotatable axle.

10. An improved intermodal rail vehicle to form a train of highway trailers as set forth in claim 5, wherein the resilient element provides a displacement capability of motion between the two lower frame weldments.

11. An improved intermodal rail vehicle to form a train of highway trailers as set forth in claim 5, wherein the resilient element includes at least one Belleville washer disposed around a shaft of the fastener and between a surface of the yoke, and a nut threadably engaging the fastener.

12. An improved intermodal rail vehicle to form a train of highway trailers as set forth in claim 5, wherein the central connection pin forms a bearing pin opening at a mid-portion thereof and extending diametrically therethrough in a direction parallel relative to the axis of rotation of the respective rotatable axle, and wherein the bearing pin is disposed in the bearing pin opening.

13. A method for using an improved intermodal rail vehicle to form a train of highway trailers as set forth in claim 5, the method characterized in that, during operation, pitching rotation between the two lower frames is enabled by providing at least one central connection pin in the connection arrangement that is rotatable along an axis that is parallel to an axis of rotation of the rotatable axle of at least one of the two lower frames;

yawing rotation between the two lower frames is enabled by providing at least one bearing pin in the connection arrangement providing rotational capability between portions of the connection arrangement along an axis of rotation that is generally vertical and generally perpendicular to the axis of rotation of the rotatable axle of at least one of the two lower frames;

rolling rotation between the two lower frames is enabled by providing at least one fastener axially connecting portions of the connection arrangement and providing rotational capability between such portions along an axis of rotation that is generally horizontal and generally perpendicular to the axis of rotation of the rotatable axle of at least one of the two lower frames; and axial displacement between the two lower frames along the fastener is enabled by providing a resilient element disposed between an end of the fastener and a component of the connection arrangement.

14. An improved intermodal rail vehicle to form a train of highway trailers as described in claim 5, further characterized by the provision of an automatic coupling means, said automatic coupler including male end assemblies attached to the ends of coupler tongues mounted to the upper frame, and mating female coupler socket assemblies mounted at the ends of highway trailers, the coupler sockets having spring loaded latch bars which snap into notches in the male coupler assembly when it enters the coupler socket, thus forming a connection between the male and female elements until said connection is released by moving the latches out of contact within the notch.

15. The improved intermodal rail vehicle to form a train of highway trailers as set forth in claim 5, wherein the gimbaled connection arrangement is capable of providing steering between the two lower frames over railroad curves with a minimum curve radius of 150 ft. (45.72 meters).

16. An improved intermodal rail vehicle to form a train of highway trailers including leading and trailing highway trailers, which are interconnected to each other and supported by the intermodal vehicle for travel on railroad tracks, each of the highway trailers including a leading coupler socket assembly at one end and a trailing coupler socket assembly at the other end, each intermodal rail vehicle having two rail wheel assemblies, two lower frame assemblies into which each of the two rail wheel assemblies are mounted, an upper frame assembly supported on the lower frame assemblies by integral air springs, the upper frame including leading and trailing load carrying structures characterized by the provision of:

an integral drawbar assembly mounted on the upper frame assembly and extending above the leading and trailing load carrying structures, each end of the assembly of an associated highway trailer supported on an associated load carrying structure to connect the associated trailer to the intermodal vehicle;

wherein the drawbar assembly has a high and a low end;

wherein the high end is adapted for entry into the front trailer coupler socket; and wherein the low end is adapted for entry into the rear trailer socket;

such that the trailers, when coupled to the intermodal rail vehicle, will run parallel to the track;

a resilient gimbaled coupling arrangement, comprising:

a pillow block forming at least one opening and connected to one of the two lower frame weldments, a rubber bushing forming a bushing opening and disposed into the at least one pillow block opening;

a vertical pin disposed within the rubber bushing opening and extending beyond the pillow block and the rubber bushing to define two free ends;

wherein each of the free ends of the vertical pin is connected to a second one of the two lower frame weldments.

* * * * *